United States Patent [19]

Ueda et al.

[11] Patent Number: 5,071,734

[45] Date of Patent: Dec. 10, 1991

[54] METHOD FOR PROCESSING SILVER HALIDE COLOR PHOTOGRAPHIC MATERIALS

[75] Inventors: Shinji Ueda; Takatoshi Ishikawa; Hiroshi Fujimoto, all of Kanagawa; Kaoru Uchiyama; Tetuya Ishizuka, both of Tokyo, all of Japan

[73] Assignee: Fuji Photo Film Co., Ltd., Kanagawa, Japan

[21] Appl. No.: 413,652

[22] Filed: Sep. 28, 1989

[30] Foreign Application Priority Data

Sep. 28, 1988 [JP] Japan ..... 63-243355

[51] Int. Cl.[5] ..... G03C 5/31; G03C 5/395; G03C 7/30

[52] U.S. Cl. ..... 430/372; 430/399; 430/398; 430/403; 430/490; 430/963

[58] Field of Search ..... 430/398, 399, 403, 963, 430/490, 372; 354/322, 325, 324

[56] References Cited

U.S. PATENT DOCUMENTS

| | | | |
|---|---|---|---|
| 4,798,783 | 1/1989 | Ishikawa et al. | 430/372 |
| 4,829,330 | 5/1989 | Yamada et al. | 354/322 |
| 4,839,273 | 6/1989 | Yamada et al. | 430/634 |
| 4,839,683 | 6/1989 | Kushima et al. | 354/322 |
| 4,876,174 | 10/1989 | Ishikawa et al. | 430/380 |
| 4,943,823 | 7/1990 | Uchiyama et al. | 354/322 |

FOREIGN PATENT DOCUMENTS

| | | |
|---|---|---|
| 0266797 | 5/1988 | European Pat. Off. . |
| 0326030 | 8/1989 | European Pat. Off. . |
| 63-187243 | 8/1988 | Japan . |
| 1-55564 | 3/1989 | Japan . |

OTHER PUBLICATIONS

Patent Abstracts of Japan, vol. 12, No. 178 (P-708)(3025) May 26, 1988.

Patent Abstracts of Japan, vol. 12, No. 388 (P-771)(3235) Oct. 17, 1988.

Patent Abstracts of Japan, vol. 13, No. 9 (P-811)(3357) Jan. 11, 1989.

Derwent Abstract of Japanese Patent 63-187243 published 8-2-88.

English Translation of Claims to Japanese Patent 62-287252, published 12/14/87.

*Primary Examiner*—Richard L. Schilling

*Assistant Examiner*—Janis L. Dote

*Attorney, Agent, or Firm*—Sughrue, Mion, Zinn, Macpeak & Seas

[57] ABSTRACT

A method for continuously processing silver halide color photographic materials using a roller conveyor type of an automatic developing apparatus, comprising:

cleaning the entire surface of a roller located over solution surface of at least one of processing baths in the automatic developing apparatus in which at least one of said processing baths comprises the color developing bath by a rinsing water replenisher or a stabilizing replenisher as a substitute for the rinsing water replenisher, and introducing the cleaning solution into the color developing bath containing at least one organic preservative selected from the group consisting of compounds represented by formulae (I), (II), (III) and (IV) and monosaccharides;

(I)

wherein $R^{11}$ and $R^{12}$ each represents hydrogen atoms, unsubstituted or substituted alkyl groups, unsubstituted or substituted alkenyl groups, unsubstituted or substituted aryl groups or hetero aromatic groups, provided that both of $R^{11}$ and $R^{12}$ are not hydrogen atoms together;

(II)

wherein $R^{21}$, $R^{22}$ and $R^{23}$ each represents independently a hydrogen atom, an alkyl group, an aryl group or a heterocyclic group; $R^{24}$ represents a hy- (Abstract continued on next page.)

drogen atom, a hydroxyl group, a hydrazino group, an alkyl group, an aryl group, a heterocyclic group, an alkoxy group, an aryloxy group, a carbamoyl group or an amino group; $X^{21}$ represents a divalent group and n represents 0 or 1; with the proviso that when n is 0, $R^{24}$ represents an alkyl group, an aryl group or a heterocyclic group;

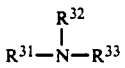

(III)

wherein $R^{31}$, $R^{32}$ and $R^{33}$ each represents hydrogen atoms, alkyl groups, alkenyl groups, aryl groups, aralkyl groups or heterocyclic groups;

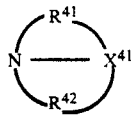

(IV)

wherein $X^{41}$ represents a trivalent atomic group needed to complete a condensed ring and $R^{41}$ and $R^{42}$ each represents alkylene groups, arylene groups, alkenylene groups or aralkylene groups.

11 Claims, 1 Drawing Sheet

METHOD FOR PROCESSING SILVER HALIDE COLOR PHOTOGRAPHIC MATERIALS

FIELD OF THE INVENTION

The present invention concerns an easy method of processing silver halide color photographic materials which provides good photographic performance and little variation.

BACKGROUND OF THE INVENTION

In the processing of silver halide color photographic materials, recently there has been much demand for maintaining the photographic performance obtained throughout continuous processing in order to provide a photographic image of stabilized color photographic performance. The following two problems must be solved in order to obtain stabilized good photographic performance. The first problem is that of reduced performance of the photographic processing solution because the components of the photographic processing solution are depleted by air oxidation, thermal decomposition, etc. The second problem is that when continuous processing is effected with an automatic developing apparatus, the photographic processing solution is concentrated by evaporation, leading to a change in its performance; also the components of the photographic processing solution deposited on the conveyor rollers located over solution surfaces in the processing baths, causing stains and scratches. Also, the above-mentioned problem of deposition of components of the photographic processing solution on the conveyor rollers (e.g., conveyor rollers which are used in various steps such as color development, desilvering (bleaching, fixing, bleach-fixing), water washing and stabilization) located over the bath in roller conveyor automatic developing apparatuses after the automatic developing apparatuses are stopped for one day or more is particularly deepseated with the usual small "minilab" automatic developing apparatus, and at the end of a day's treatment operations, the racks and guides located over the baths must be removed and rinsed with running water or with a washing bottle. Therefore, there is much demand for a processing method for automatic developing apparatuses which will easily provide a stabilized good photographic image.

SUMMARY OF THE INVENTION

A first object of the present invention is to provide a method for processing the silver halide color photographic materials in which a good photographic performance is obtained, and the performance is stabilized in the continuous processing.

A second object of the present invention is to provide a method for processing the silver halide color photographic materials in which good photographic performance is maintained and the cleaning work is easy.

A third object of the present invention is to provide a method for processing the silver halide color photographic materials using the automatic developing apparatus with a simplified washing (cleaning) equipment in which good photographic performance is maintained and the cleaning work is easy.

The present invention was attained by the following method.

The objects were achieved by a method for continuously processing silver halide color photographic materials using a roller conveyor type of an automatic developing apparatus, comprising:

cleaning the entire surface of a roller located over solution surface of at least one of processing baths in the automatic developing apparatus in which at least one of said processing baths comprises the color developing bath by a rinsing water replenisher or a stabilizing replenisher as a substitute for the rinsing water replenisher, and introducing the cleaning solution into the color developing bath containing at least one organic preservative selected from the group consisting of compounds represented by formulae (I), (II), (III) and (IV) and monosaccharides:

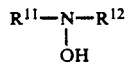

(I)

wherein $R^{11}$ and $R^{12}$ each represents hydrogen atoms, unsubstituted or substituted alkyl groups, unsubstituted or substituted alkenyl groups, unsubstituted or substituted aryl groups or hetero aromatic groups, provided that both of $R^{11}$ and $R^{12}$ are not hydrogen atoms together;

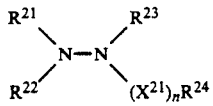

(II)

wherein $R^{21}$, $R^{22}$ and $R^{23}$ each represents independently a hydrogen atom, an alkyl group, an aryl group or a heterocyclic group; $R^{24}$ represents a hydrogen atom, a hydroxyl group, a hydrazino group, an alkyl group, an aryl group, a heterocyclic group, an alkoxy group, an aryloxy group, a carbamoyl group or an amino group; $X^{21}$ represents a divalent group and n represents 0 or 1; with the proviso that when n is 0, $R^{24}$ represents an alkyl group, an aryl group or a heterocyclic group;

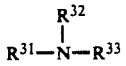

(III)

wherein $R^{31}$, $R^{32}$ and $R^{33}$ each represents hydrogen atoms, alkyl groups, alkenyl groups, aryl groups, aralkyl groups or heterocyclic groups;

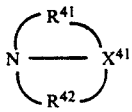

(IV)

wherein $X^{41}$ represents a trivalent atomic group needed to complete a condensed ring and $R^{41}$ and $R^{42}$ each represents alkylene groups, arylene groups, alkenylene groups or aralkylene groups.

BRIEF DESCRIPTION OF THE DRAWING

The Figure is a general view of the automatic developing apparatus of the present invention used in Example 2. In the Figure, P1, P2, PS1 and PS2 are respectively the color developing bath, bleach-fixing bath, first rinsing bath and second rinsing bath of the processing, and B1, B2, B3 and B4 are respectively the replenishment bottles for the color developing bath, bleach-fixing bath, rinsing bath and additives for bleach-fixing.

DETAILED DESCRIPTION OF THE INVENTION

Figure 1:
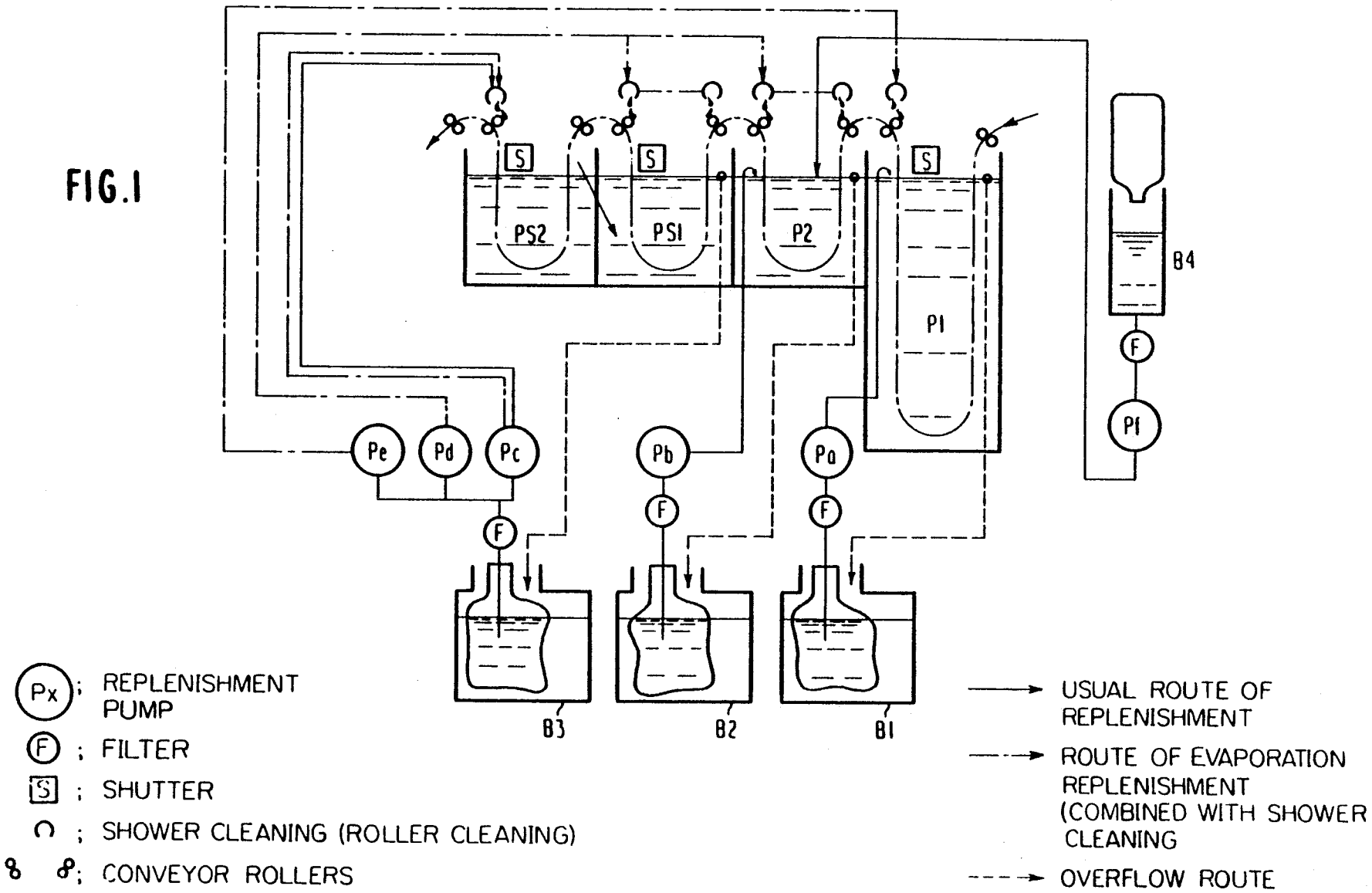

JP-A-62-287252 and JP-A-63-187243 (the term "JP-A" as used herein refers to a "published unexamined Japanese patent application") proposed a method in which the rinsing water for the conveyor roller, at the outlet of the processing tank, is supplied to make up for the evaporation of processing solution.

However, there are no suggestions and teachings in JP-A-62-287252 and JP-A-63-187243 as to the improvement of stabilization in the photographic performance during the continuous processing of the color photographic materials.

As a result of their studies, the improvement effect achieved by the inventors of the processing of the present invention can be summarized as follows. In the color developing process, it proved possible not only to restrain fluctuations (i.e., variation) of photographic performance (especially fluctuations of the maximum density) but also to restrain greatly the scratching of the surface of the photosensitive material during continuous processing. In the process having a bleaching ability (particularly, bleach-fixing process) and rinsing process, it proved possible to lower the minimum density and improve preservability and greatly restrain staining of the surface of the photosensitive material. Moreover, not only are these effects very important in doing away with the need of maintenance operations after processing as described above, but small volume processing and low replenishment processing are now possible and photographic processing is made that much easier.

In the present invention, a rinsing water replenisher or stabilizing replenisher as a substitute for the rinsing water is used as the roller washing solution in the photographic processing solution, and when the washing solution is introduced into the various processing solutions, there is no need to set up a new tank or pipe arrangement to replenish evaporated water, which is very convenient. Moreover, when a rinsing water replenisher or stabilizing replenisher as a substitute for the rinsing water is added to the color developing bath, the less the amount of the rinsing water replenisher or stabilizing replenisher as a substitute for the rinsing water used in the rinsing bath or stabilizing bath as a substitute for the rinsing bath, and the less will be the amount of replenisher used, which is particularly preferred in a small automatic developing machine with a combined replenisher tank and processing area.

The amount of water added to the photographic processing bath (solution) is preferably from 0.1 to 1.2 times the amount evaporated from the various processing tanks in the automatic developing machine; especially if the amount is from 0.3 to 0.9 times, a good result is achieved irrespective of the frequency of water addition. It does not matter if water is added only about once a week, but it is particularly desirable to add water more than once a day. It is also particularly desirable to study the various evaporation amounts when the automatic developing machine stops operations (on rest days), when it is at a standstill (e.g., night) and when it is working and add only the amount of water suitable at that time.

Furthermore, a smaller amount of evaporation in the automatic developing machine is preferable for ease of avoiding dilution by excess addition of water when the automatic developing machine is processed in different environmental conditions. A preferred method for reducing the amount of evaporation in this manner is to have an open area value in the automatic developing apparatus of 0.05 $cm^{-1}$ or less, more preferably from 0.001 to 0.05 $cm^{-1}$ and most preferably from 0.001 to 0.01 $cm^{-1}$. The term "open area value" here means the value obtained when the solution surface area of the processing solution (bath) (area ($cm^2$) contacting with air) is divided by the volume (ml) of processing solution in the processing tank.

The color developing solution (bath) which is used in the present invention can contain at least one organic preservative selected from the group consisting of compounds represented by formulae (I), (II), (III) and (IV) and monosaccharides in an effective amount.

"Organic preservative" here means an organic compound which, when added to a processing solution for color photographic material, reduces the deterioration rate of primary aromatic amine color developing solution. That is, it is an organic compound having the function for preventing oxidation of the color developing solution by air, etc.

The amount of the following compounds added to the color developing solution as an organic preservative is from 0.005 mol/liter to 0.5 mol/liter and preferably from 0.03 mol/liter to 0.1 mol/liter.

The formulae and specific compounds which are used as organic preservatives in the present invention are described below.

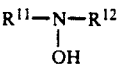

(I)

wherein $R^{11}$ and $R^{12}$ each represents hydrogen atoms, unsubstituted or substituted alkyl groups, unsubstituted or substituted alkenyl groups, unsubstituted or substituted aryl groups (having preferably 6 to 12 carbon atoms and more preferably 6 to 10 carbon atoms) or hetero aromatic groups Both of $R^{11}$ and $R^{12}$ are not hydrogen atoms together but may combine with one another to form hetero ring with nitrogen atoms.

The cyclic structure of the heterocyclic rings is a 5- or 6-membered chain, formed from carbon atoms, hydrogen atoms, halogen atoms, nitrogen atoms, sulfur atoms, etc., and may be saturated or unsaturated.

It is preferable that $R^{11}$ and $R^{12}$ should be alkyl groups or alkenyl groups, preferably having 1 to 10 carbon atoms and more preferably 1 to 5 carbon atoms. Examples of hetero rings containing nitrogen formed by a combination of $R^{11}$ and $R^{12}$ include piperidyl groups, pyrrolidyl groups, N-alkylpiperazyl groups, morpholyl groups, indolinyl groups, benzotriazole groups, etc.

Preferred substituents for $R^{11}$ and $R^{12}$ are hydroxyl groups, alkoxy groups, alkylsulfonyl groups, arylsulfonyl groups, amide groups, carboxyl groups, cyano groups, sulfo groups, nitro groups and amino groups.

Specific examples of the compounds represented by formula (I) are set forth below, but the present invention is not to be construed as being limited to these compounds.

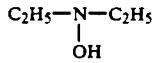

I-1

-continued $CH_3OC_2H_4-N(OH)-C_2H_4-OCH_3$ I-2

$C_2H_5OC_2H_4-N(OH)-CH_2-CH=CH_2$ I-3

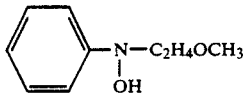

I-4

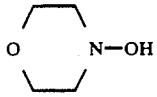

I-5

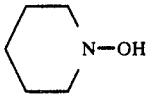

I-6

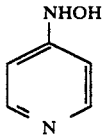

I-7

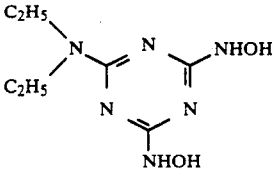

I-8

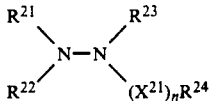

(II)

wherein $R^{21}$, $R^{22}$ and $R^{23}$ each represents independently a hydrogen atom, an alkyl group, an aryl group or a heterocyclic group. R24 represents a hydrogen atom, a hydroxyl group, a hydrazino group, an alkyl group, an aryl group, a heterocyclic group, an alkoxy group, an aryloxy group, a carbamoyl group or an amino group. $X^{21}$ represents a divalent group and n represents 0 or 1. When n is 0, $R^{24}$ represents an alkyl group, an aryl group or a heterocyclic group. $R^{23}$ and $R^{24}$ may together form a hetero ring.

The hydrazine-related compounds of the present invention represented by formula (II) (hydrazines and hydrazides) are now described in detail.

$R^{21}$, $R^{22}$ and $R^{23}$ each independently represents a hydrogen atom, a substituted or unsubstituted alkyl group (preferably having from 1 to 20 carbon atoms, e.g., methyl, ethyl, sulfopropyl, carboxybutyl, hydroxyethyl, cyclohexyl, benzyl, phenethyl), a substituted or unsubstituted aryl group (preferably having from 6 to 20 carbon atoms, e.g., phenyl, 2,5-dimethoxyphenyl, 4-hydroxyphenyl, 2-carboxyphenyl) or a substituted or unsubstituted heterocyclic group (preferably having from 1 to 20 carbon atoms, preferably a 5- or 6-membered ring, containing at least one of oxygen, nitrogen, sulfur, etc., as hetero atoms, e.g., pyridin-4-yl, N-acetylpiperidin-4-yl).

$R^{24}$ represents a hydrogen atom, a hydroxyl group, a substituted or unsubstituted hydrazino group (e.g., hydrazino, methylhydrazino, phenylhydrazino), a substituted or unsubstituted alkyl group (preferably having from 1 to 20 carbon atoms, e.g., methyl, ethyl, sulfopropyl, carboxybutyl, hydroxyethyl, cyclohexyl, benzyl, t-butyl, n-octyl), a substituted or unsubstituted aryl group (preferably having from 6 to 20 carbon atoms, e.g., phenyl, 2,5-dimethoxyphenyl, 4-hydroxyphenyl, 2-carboxyphenyl, 4-sulfophenyl), a substituted or unsubstituted heterocyclic group (preferably having from 1 to 20 carbon atoms and preferably a 5- or 6-membered ring, containing at least one of oxygen, nitrogen and sulfur as hetero atoms, e.g., pyridin-4-yl, imidazolyl), a substituted or unsubstituted alkoxy group (preferably having from 1 to 20 carbon atoms, more preferably from 1 to 10 carbon atoms and most preferably from 1 to 5 carbon atoms, e.g., methoxy, ethoxy, methoxyethoxy, benzyloxy, cyclohexyloxy, octyloxy), a substituted or unsubstituted aryloxy group (preferably having from 6 to 20 carbon atoms, e.g., phenoxy, p-methoxyphenoxy, p-carboxyphenyl, p-sulfophenoxy), a substituted or unsubstituted carbamoyl group (preferably having from 1 to 20 carbon atoms, more preferably from 1 to 10 carbon atoms and most preferably from 1 to 5 carbon atoms, e.g., unsubstituted carbamoyl, N,N-diethylcarbamoyl, phenylcarbonyl) or a substituted or unsubstituted amino group (preferably having from 0 to 2 carbon atoms, e.g., amino, hydroxyamino, methylamino, hexylamino, methoxyethylamino, carboxyethylamino, sulfoethylamino, N-phenylamino, p-sulfophenylamino).

Further preferred substituents for $R^{21}$, $R^{22}$, $R^{23}$ and $R^{24}$ include halogen atoms (e.g., chlorine, bromine), hydroxyl groups, carboxyl groups, sulfo groups, amino groups, alkoxy groups, amide groups, sulfonamide groups, carbamoyl groups, sulfamoyl groups, alkyl groups, aryl groups, aryloxy groups, alkylthio groups, arylthio groups, nitro groups, cyano groups, sulfonyl groups, sulfinyl groups, which may be further substituted.

$X^{21}{}_n$ is a divalent organic radical in which $X^{21}$ is —CO—, —SO— or $$-\overset{\overset{\displaystyle NH}{\|}}{C}-$$

and n is 0 or 1. When n is 0, $R^{24}$ represents a substituted or unsubstituted alkyl group, an aryl group or a heterocyclic group. $R^{21}$ and $R^{22}$ and/or $R^{23}$ and $R^{24}$ may combine to form heterocyclic groups. When n is 0, at least one of $R^{21}$ to $R^{24}$ is preferably a substituted or unsubstituted alkyl group. It is particularly preferred that $R^{21}$, $R^{22}$, $R^{23}$ and $R^{24}$ each is hydrogen atoms or substituted or unsubstituted alkyl groups (however, $R^{21}$, $R^{22}$, $R^{23}$ and $R^{24}$ are never simultaneously hydrogen atoms). Particularly preferred combinations are cases where $R^{21}$, $R^{22}$ and $R^{23}$ are hydrogen atoms and $R^{24}$ is a substituted or unsubstituted alkyl group, cases where $R^{21}$ and $R^{23}$ are hydrogen atoms and $R^{22}$ and $R^{24}$ are substituted or unsubstituted alkyl groups or where $R^{21}$ and $R^{22}$ are hydrogen atoms and $R^{23}$ and $R^{24}$ are substituted or unsubstituted alkyl groups (in this case $R^{23}$ and $R^{24}$ may combine to form a hetero ring). When n is 1, —CO— is preferred for $X^{21}$, a substituted or unsubstituted amino group is preferred for $R^{24}$ and substituted or unsubstituted alkyl groups are preferred for $R^{21}$ to $R^{23}$.

It is more preferred that n is 0.

Alkyl groups represented by $R^{21}$ to $R^{24}$ preferably have from 1 to 10 carbon atoms and more preferably from 1 to 7 carbon atoms. Preferred substituents for the alkyl groups which might be mentioned include hydroxyl groups, carboxyl groups, sulfonic acid groups and phosphonic acid groups. When there are 2 or more substituents, these may be the same or different.

The compounds of formula (II) may form dimers, trimers or polymers with $R^{21}$, $R^{22}$, $R^{23}$ and $R^{24}$.

Specific examples are now given of compounds represented by formula (II), but the present invention is not limited by these.

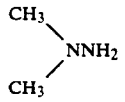
(II-1)

$CH_3NHNHCH_3$ (II-2)

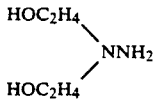
(II-3)

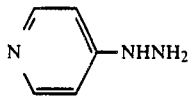
(II-4)

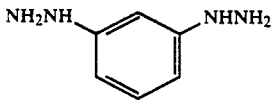
(II-5)

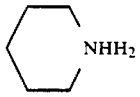
(II-6)

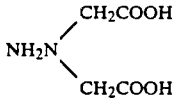
(II-7)

$HOOCCH_2NHNHCH_2COOH$ (II-8)

$NH_2NH(CH_2)_5NHNH_2$ (II-9)

$NH_2NHCH_2CH_2OH$ (II-10)

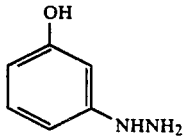
(II-11)

$NH_2NH-(CH_2)_3-SO_3H$ (II-12)

$NH_2NH-(CH_2)_4-SO_3H$ (II-13)

$NH_2NH-(CH_2)_3-COOH$ (II-14)

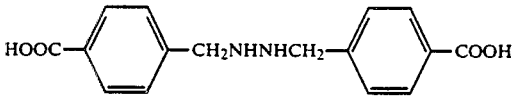
(II-15)

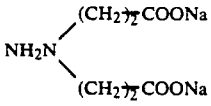
(II-16)

-continued

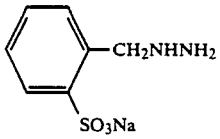
(II-17)

$NaOOCCH(CH_3)NHNHCH(CH_3)COONa$ (II-18)

$NH_2NHCH_2CH_2COONa$ (II-19)

$NH_2NHCH_2COONa$ (II-20)

$H_2NNHCH_2CH_2SO_3Na$ (II-21)

$H_2NNHCH(C_4H_9(n))COOH$ (II-22)

$H_2NNHCH(C_6H_{13}(n))COOH$ (II-23)

$H_2NN(CH(C_4H_9(n))COOH)_2$ (II-24)

$H_2NN(CH_2CH_2SO_3Na)_2$ (II-25)

$H_2NN(CH_2CH_2CH_2SO_3Na)_2$ (II-26)

$H_2NN(CH(C_2H_5(n))COOH)_2$ (II-27)

$H_2NNHCH(CH_3)COOH$ (II-28)

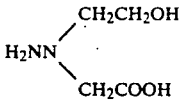
(II-29)

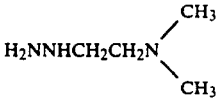
(II-30)

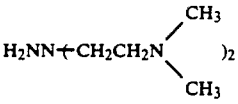
(II-31)

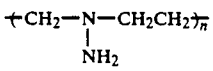
(II-32)

n = 50 to 60
Average molecular weight: about 4,000

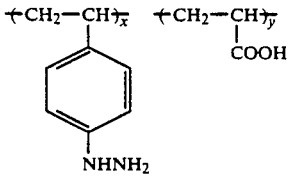
(II-33)

x/y = 60/40
Average molecular weight: about 20,000

$NH_2NHCONH_2$ (II-34)

-continued
$NH_2NHC(=NH)NH_2$ (II-35)
$NH_2NHCONHNH_2$ (II-36)
$NH_2NHSO_3H$ (II-37)
$NH_2NHSO_2NHNH_2$ (II-38)
$CH_3NHNHSO_2NHNHCH_3$ (II-39)
$NH_2NHCONH-(CH_2)_3-NHCONHNH_2$ (II-40)
(II-41)
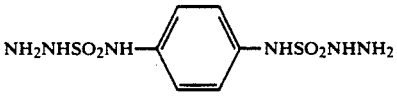
$NH_2NHCOCONHNH_2$ (II-42)
(II-43)
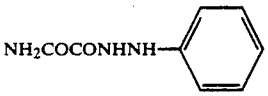
(II-44)
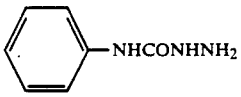
(II-45)
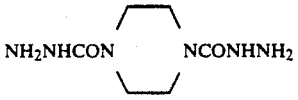
$NH_2COCONHNH_2$ (II-46)
(II-47)
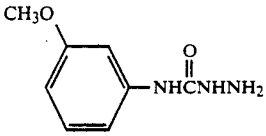
(II-48)
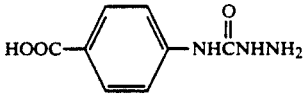
(II-49)
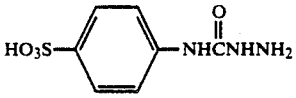
(II-50)
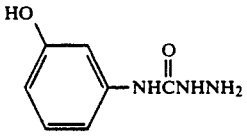
(II-51)
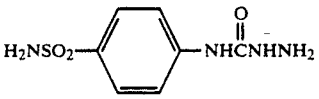
(II-52)
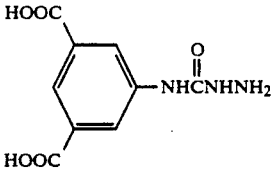
-continued
(II-53)
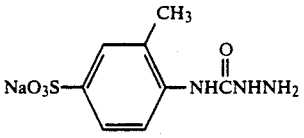
(II-54)
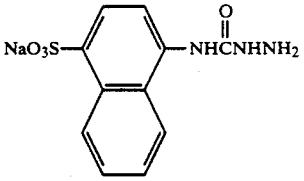
(II-55)
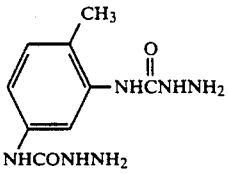
(II-56)
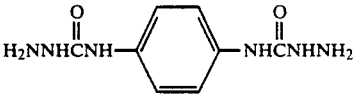
(II-57)
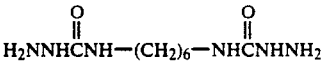
(II-58)
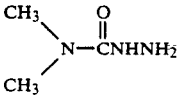
(II-59)
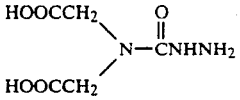
(II-60)
$NaO_3SCH_2CH_2NHC(=O)NHNH_2$
(II-61)
$HOOCCH_2CH_2NHC(=O)NHNH_2$
(II-62)
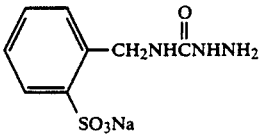
$NH_2NHCOOC_2H_5$ (II-63)
$NH_2NHCOCH_3$ (II-64)
(II-65)
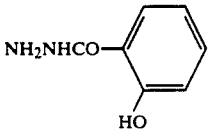
(II-66)
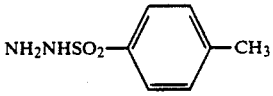
$NH_2NHCH_2PO_3H_2$ (II-67)

-continued (II-68)

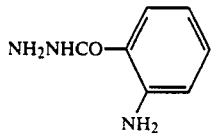

(II-69)

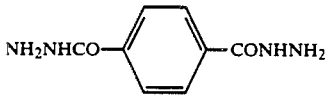

(II-70)

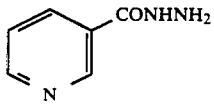

(II-71)

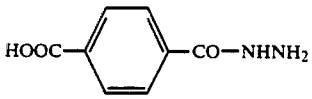

(II-72)

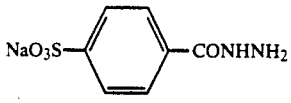

(II-73) $(CH_3)_3CCONHNH_2$ (II-74) $(CH_3)_3CO\overset{O}{\overset{\|}{C}}NHNH_2$ (II-75)

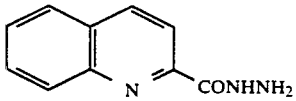

(II-76)

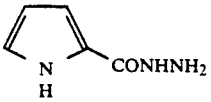

(II-77)

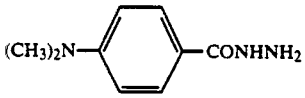

(II-78)

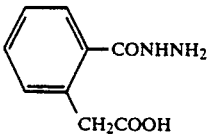

(II-79)

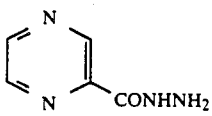

(II-80) $HOCH_2CH_2SO_2NHNH_2$ (II-81) $NaO_3SCH_2CH_2CONHNH_2$ (II-82) $H_2NCONHCH_2CH_2SO_2NHNH_2$

-continued (II-83)

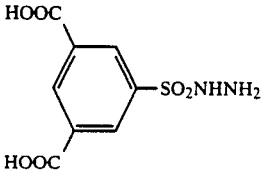

(II-84)

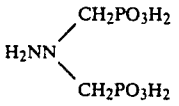

(II-85) $H_2NNHCH_2CH_2PO_3H_2$ (II-86)

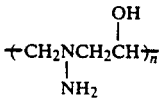

n = 40 to 60

In addition to the above specific examples, those disclosed in European Patent 254280A, Japanese Patent Application No. 61-171682 at pages 10 to 22, and Japanese Patent Application No. 61-173468 at pages 9 to 19 might be mentioned.

Most of the compounds represented by formula (II) may be obtained commercially or may be synthesized by the general synthetic methods described in sources such as *Organic Syntheses*, Coll. Vol. 2, pp. 208–213; *J. Amer. Chem. Soc.*, 36, 1747 (1914); *Yukagaku (Petrochemistry)*, 24, 31 (1975); *J. Org. Chem.*, 25, 44 (1960); *Yakugaku Zasshi*, 91, 1127 (1971); *Organic Syntheses*, Coll. Vol. 1, p. 450;, *Shinjikken Kagaku Koza*, 14, III, pp. 1621–1628 (published by Maruzen); *Beil.*, 2, 559; *Beil.*, 3, 117; E. B. Mohr et al., *Inorg. Syn.*, 4, 32 (1953); F. J. Willson, E. C. Pickering, *J. Chem. Soc.*, 123, 394 (1923); N. J. Leonard, J. H. Boyer, *J. Org. Chem.*, 15, 42 (1950); *Organic Syntheses*, Coll. Vol. 5, p. 1055; P. A. S. Smith, *Derivatives of Hydrazine and Other Hydronitrogens Having N-Bonds*, pp. 120–124, pp. 130–131, The Benjamin/Cummings Company (1983); Staniey R. Sandier, *Waif Karo Organic Functional Group Preparations*, Vol. 1, 2nd Ed., p.457.

(III)

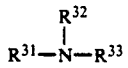

wherein $R^{31}$, $R^{32}$ and $R^{33}$ each represents hydrogen atoms, alkyl groups (having preferably 1 to 10 carbon atoms and more preferably 1 to 6 carbon atoms), alkenyl groups (having preferably 1 to 10 carbon atoms and more preferably 1 to 6 carbon atoms), aryl groups (having preferably 6 to 12 carbon atoms and more preferably 6 to 10 carbon atoms), aralkyl groups (having preferably 1 to 10 carbon atoms and more preferably 1 to 6 carbon atoms) or heterocyclic groups. Here $R^{31}$ may combine with $R^{32}$, $R^{31}$ may combine with $R^{33}$ or $R^{32}$ may combine with $R^{33}$ to form nitrogen-containing heterocyclic groups.

Here $R^{31}$, $R^{32}$ and $R^{33}$ may have substituents. Hydrogen atoms and alkyl groups (having preferably 1 to 10 carbon atoms and more preferably 1 to 6 carbon atoms) are particularly preferred as substituents for $R^{31}$, $R^{32}$ and $R^{33}$. Substituents which might be mentioned include hydroxyl groups, sulfone groups, carboxyl groups, halogen atoms, nitro groups, amino groups, etc.

Specific examples of the compounds represented by formula (III) are set forth below, but the present invention is not to be construed as being limited to these compounds.

$N(CH_2CH_2OH)_3$ III-1

$H_2NCH_2CH_2OH$ III-2

$HN(CH_2CH_2OH)_2$ III-3

$C_7H_{15}N(CH_2CH(OH)CH_2OH)_2$ III-4

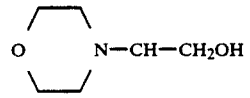
III-5

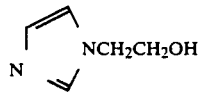
III-6

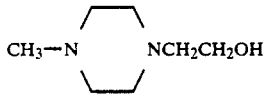
III-7

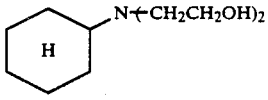
III-8

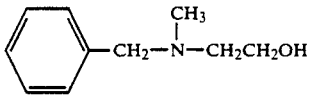
III-9

$(HOCH_2CH_2)_2NCH_2CH_2SO_2CH_3$ III-10

$HN(CH_2COOH)_2$ III-11

$HOOCCH_2CH_2CH(NH_2)COOH$ III-12

$H_2NCH_2CH_2SO_2NH_2$ III-13

$(C_2H_5)_2N-CH_2CH_2OCH_2CH_2OH$ III-14

$H_2N-C(CH_2OH)_2$ III-15

$HOCH_2CH(NH_2)COOH$ III-16

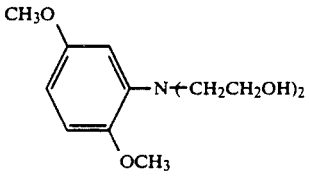
III-17

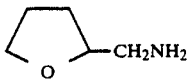
III-18

-continued

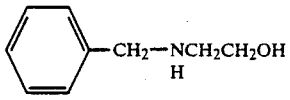
III-19

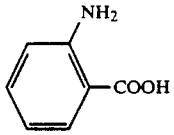
III-20

The color developing solution can also include organic preservatives represented by formula (IV):

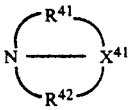
(IV)

wherein $X^{41}$ represents a trivalent atomic group needed to complete a condensed ring and $R^{41}$ and $R^{42}$ each represents alkylene groups, arylene groups, alkenylene groups or aralkylene groups.

Here $R^{41}$ and $R^{42}$ may be the same or different.

In formula (IV), particularly preferred compounds are those represented by formulae (1-a) and (1-b).

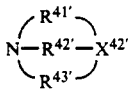
(1-a)

In formula (1-a), $X^{42'}$ represents —N or —CH. $R^{41'}$ and $R^{42'}$ are defined similarly to $R^{41}$ and $R^{42}$, respectively, in formula (IV), $R^{43'}$ represents the same groups as $R^{41'}$ and $R^{42'}$ or $$-CH_2\overset{O}{\overset{\|}{C}}-.$$

In formula (1-a), $X^{42'}$ is preferably —N. The carbon number of $R^{41'}$, $R^{42'}$ and $R^{43'}$ is preferably 6 or less, more preferably 3 or less and most preferably 2.

$R^{41'}$, $R^{42'}$ and $R^{43'}$ each represents preferably alkylene groups or arylene groups and most preferably alkylene groups.

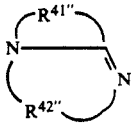
(1-b)

In formula (1-b), $R^{41''}$ and $R^{42''}$ are defined similarly to $R^{41}$ and $R^{42}$, respectively, in formula (IV).

In formula (1-b), the carbon number of $R^{41''}$ and $R^{42''}$ is preferably 6 or less. $R^{41''}$ and $R^{42''}$ represent preferably alkylene groups or arylene groups and most preferably alkylene groups.

Among the compounds of formulae (1-a) and (1-b), compounds represented by formula (1-a) are particularly preferred.

Specific examples of the compounds represented by formula (IV) are set forth below, but the present invention is not to be construed as being limited to these compounds.
IV-1
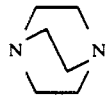
IV-2
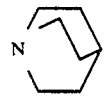
IV-3
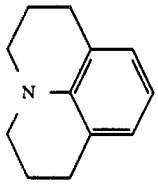
IV-4
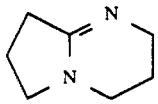
IV-5
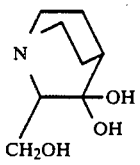
IV-6
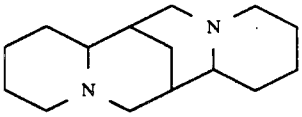
IV-7
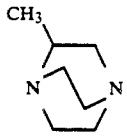
IV-8
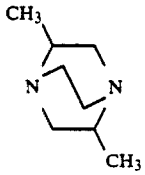
IV-9
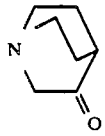
IV-10
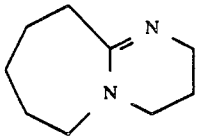
-continued
IV-11
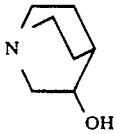
IV-12
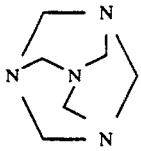
IV-13
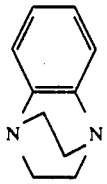
IV-14
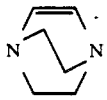
IV-15
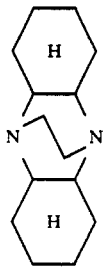
IV-16
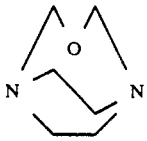
IV-17
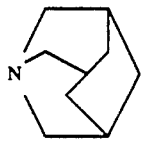
IV-18
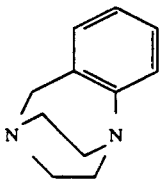
Most of the compounds represented by formula (IV) can easily be obtained commercially.
They can also be synthesized as described in the following references:
Khim. Geterotsikl. Soedin. (2), 272-5 (1976)
U.S., U.S. Pat. No. 3,297,701, 10 Jan., 1967, 6 pp.
U.S., U.S. Pat. No. 3,375,252, 26 Mar., 1968, 2 pp.
Khim. Geterotsikl. Soedin. (8), 1123-6 (1976)

U.S., U.S. Pat. No. 4,092,316, 30 May, 1978, 7 pp., etc.

Two or more of the above organic preservatives may be used in combination. A preferred combination is at least one compound selected from the group consisting of formulae (I) and (II) and at least one compound selected from the group consisting of formulae (III) and (IV).

Sugars also are preferred organic preservatives.

Sugars (also known as carbohydrates) consist of monosaccharides and polysaccharides, which mostly have formula $C_nH_{2m}O_m$, wherein m and n each represents 3 to 10 and preferably 3 to 6. "Monosaccharide" includes the general name for aldehydes or ketones of polyhydric alcohols (respectively known as aldose and ketose), their reduced derivatives, oxidized derivatives and dehydrated derivatives and aminosaccharides, thiosaccharides, etc., covering a wide range of derivatives. "Polysaccharide" means the product of dehydration and condensation of 2 or more of the aforementioned monosaccharides.

The more preferred of these sugars are an aldose, possessing a reducing aldehyde group, and its derivatives; especially preferred are those corresponding to monosaccharides among these.

Specific examples of sugars are set forth below, but the present invention is not to be construed as being limited to these compounds.

V-1 D-xylose
V-2 L-arabinose
V-3 D-ribose
V-4 D-deoxyribose
V-5 D-glucose
V-6 D-galactose
V-7 D-mannose
V-8 glucosamine
V-9 L-sorbose In the color developing solution (bath) of the present invention, at least one compound selected from compounds described above can be contained in an effective amount and further well-known organic preservatives such as hydroxylamine may be contained in the color developing solution in an amount in which the effect of the present invention is not injured.

The means in the present invention by which the rinsing water or stabilizer as a substitute for the rinsing water rinses the entire roller surface of the conveyor rollers located over the photographic processing baths is now described.

The Figure is a schematic representation of the automatic developing machine using the rinsing method of the present invention.

In the Figure, P1, P2, Ps1 and Ps2 respectively represent the color developing bath, the bleach-fixing bath, and the first and second rinsing bath. B1, B2, B3 and B4 are respectively the bottle with a replenisher of the color developer, the bottle with a replenisher of bleach-fixing, the bottle with a replenisher of rinsing water and the bottle with additives of bleach-fixing. In the Figure, there is shower rinsing (roller rinsing) of the conveyor rollers located over the solution surfaces of the color developer bath, bleach-fixing bath and first rinsing bath. As concerns the structure of the automatic developing apparatus containing the roller washing mechanism, it is possible to adopt the specific structure described in JP-A-62-287252 and JP-A-63-187243.

The method for adding roller rinsing water (roller washing water) to the various processing baths is described herein. If, during rinsing, all the rollers are revolved, an effective and preferable effect is obtained. As shown in the Figure, it is preferable to replenish the rinsing water or stabilizer as a substitute for the rinsing water while washing the conveyor roller over the final (water) rinsing bath or final stabilizer bath as a substitute for the (water) rinsing bath. That is, the final (water) rinsing bath or final stabilizer bath as a substitute for the (water) rinsing bath is preferably used for both the washing of the conveyor roller and the replenishment by running a general replenisher to the roller.

The photographic processing solutions of the present invention are now described.

Color Developing Solution (Bath)

The color developing solution used in the present invention contains well known primary aromatic amine color developing agents. Preferred examples are p-phenylenediamine derivatives. Typical examples are given below, although the present invention is not restricted to these.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl-N-β-hydroxyethyl-)amino]aniline
D- 6: 4-Amino-3-methyl-N-ethyl-N-[β-(methanesulfonamido)ethyl]aniline
D- 7: N-(2-Amino-5-diethylaminophenylethyl)methanesulfonamide
D- 8: N,N-Dimethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Among these, D-4, D-5 and D-6 are particularly preferred.

These p-phenylenediamine derivatives may also be sulfates, hydrochlorides, sulfites, p-toluenesulfonates, etc. The amount used of the primary aromatic amine developing agent is preferably about 0.1 g to about 20 g per liter of developing solution and more preferably about 0.5 g to about 10 g.

If desired, sulfites such as sodium sulfite, potassium sulfite, sodium bisulfite, potassium bisulfite, sodium metasulfite, potassium metasulfite, and carbonyl sulfite adducts may be added. However, with a view to improving the color-forming properties of the color developing bath, the less the amount of sulfite ions added the better.

Specifically, the amount added to 1 liter of color developing solution (i.e., bath) is 0 to 0.01 mol, more preferably 0 to 0.005 mol, and most preferably 0 to 0.002 mol. The smaller the amount of sodium sulfite added, the less change in the photographic characteristics during small volume processing as mentioned above, and this is preferable.

For the same reasons as above, it is preferred that the amount of hydroxylamine preservative employed is generally small. That is, it is preferably 0 to 0.02 mol, more preferably 0 to 0.01 mol, most preferably 0 to 0.005 mol per liter of the color developing solution (bath).

The color developing solution used in the present invention has preferably a pH of 9 to 12 and more preferably 9 to 11.0. The color developing solution may also contain other compounds well known as developing solution ingredients.

It is preferable to use various buffers in order to maintain the above pH. Buffers which may be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. Use of carbonates, phosphates, tetraborates, and hydroxybenzoates have advantages such as excellent solubility and buffering ability in the high pH of 9.0 or more, no deleterious effect on the photographic performance (fogging and the like) when added to the color developing solution and are inexpensive, so that the use of these buffers is particularly preferred.

Examples of these buffers which might be mentioned include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention is not restricted to these compounds.

The amount of the buffer added to the color developing solution is preferably 0.1 mol/liter or more and particularly preferably 0.1 to 0.4 mol/liter. In addition, the developing solution may contain various chelating agents as preventors of precipitation of calcium and magnesium, or in order to improve the stability of the developing solution (bath).

Organic oxides are preferred as chelating agents, examples of compounds of this kind include aminopolycarboxylates mentioned in JP-B-48-30496 and JP-B-44-30232, the organic phosphonates mentioned in JP-A-56-97347, JP-B-56-39359 and in West German Patent 2,227,639, the phosphonocarboxylates mentioned in JP-A-52-102726, JP-A-53-42730, JP-A-54-121127, JP-A-55-126241 and JP-A-55-659506, in addition to the compounds mentioned in JP-A-58-195845, JP-A-58-203440 and JP-B-53-40900. Specific examples are now given, which, however, are not restricted to them.

The examples of the chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

If desired, two or more of these chelating agents may be used together.

The amount of these chelating agents added is preferably the quantity necessary to block the metal ions in the color developing solution, e.g., about 0.1 to 10 g per liter of the color developing solution.

If desired, any development accelerator may be added to the color developing solution. However, it is preferable that the color developing solution of the present invention contain substantially no benzyl alcohol for reasons of avoiding environmental pollution, solution adjustibility and preventing color staining. Here, "substantially no benzyl alcohol" means the amount of the benzyl alcohol is 2 ml or less per liter and preferably 0 ml.

An outstanding effect can be obtained from the use of the aforementioned organic preservative according to the present invention in the processing stage using a color developing solution containing substantially no benzyl alcohol.

Other developing accelerators which may be added, if desired, include thioether compounds described in JP-B-37-16088, JP-B-37-5987, JP-B-38-7826, JP-B-44-12380 and JP-B-45-9019 and U.S. Pat. No. 3,813,247, etc., p-phenylenediamine compounds described in JP-A-52-49829 and JP-A-50-15554, quaternary ammonium salts described in JP-A-50-137726, JP-B-44-30074, JP-A-56-156826 and JP-A-52-43429, amine compounds disclosed in U.S. Pat. Nos. 2,494,903, 3,128,182, 4,230,796, 3,253,919, JP-B-41-11431, U.S. Pat. Nos. 2,482,546, 2,596,926, 3,582,346, etc., polyalkylene oxides mentioned in JP-B-37-16088 and JP-B-42-25201, U.S. Pat. No. 3,128,183, JP-B-41-11431 and JP-B-42-23883 and U.S. Pat. No. 3,532,501, also 1-phenyl-3-pyrazolidones, imidazoles, etc.

If desired, any desired antifogging agent may be added in the present invention. Examples of antifogging agents which may be used include alkali metal halide such as sodium chloride, potassium bromide, potassium iodide. Also, organic antifogging agents may be used. Typical examples of organic antifogging agents include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, adenine, etc.

The color developing solution used in the present invention preferably contains a fluorescent whitener. Preferred fluorescent whiteners are 4,4'-diamino-2,2'-disulfostilbene compounds. The amount added is generally 0 to 5 g/liter and preferably 0.1 to 4 g/liter.

Various surfactants may be added, if desired, such as alkylsulfonic acids, arylphosphonic acids, aliphatic carboxylic acids, aromatic carboxylic acids, etc.

The processing temperature of the color developing solution of the present invention is generally from 20° C. to 50° C. and preferably 30° C. to 40° C. The processing time is generally from 20 seconds to 2 minutes and preferably 30 seconds to 1 minute. The smaller the replenisher amount the better: the amount is generally from 20 to 600 ml, preferably from 30 to 300 ml, more preferably from 30 ml to 120 ml per $m^2$ of the photosensitive material.

Bleach-Fixing Solution (Bath)

Any bleaching agent may be used in the bleach-fixing solution (bath) of the present invention but particularly preferred are complex organic Fe(III) complex salts (e.g., complex salts of ethylenediaminetetraacetic acid, diethylenetriaminepentaacetic acid or other aminopolycarboxylic acid, aminopolyphosphonic acid, phosphonocarboxylic acid and organic phosphonic acid) or organic acids such as citric acid, tartaric acid, malic acid, etc., or persulfates, hydrogen peroxide, etc.

Of these, complex organic Fe(III) salts are specially preferred because of the rapid processing and the prevention of environmental pollution. Examples of useful aminopolycarboxylic acids, aminopolyphosphonic acids or organic phosphonic acids or salts thereof which might be mentioned for the formation of complex organic Fe(III) salts include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraacetic acid, etc.

These compounds may be either sodium, potassium, lithium or ammonium salts. Of these compounds, especially preferred organic Fe(III) complex salts in view of their high bleaching ability are those of ethylenediaminetetraacetic acid, diethylenetriaminepentaacetic acid, cyclohexanediaminetetraacetic acid, 1,3-diaminopropanetetraacetic acid and methyliminodiacetic acid.

These ferric ion complex salts may be used in the form of complex salts, or ferric ion complex salts may be formed in solution using ferric salts, e.g., ferric sulfate, ferric chloride, ferric nitrate, ferric ammonium sulfate, ferric phosphate, etc., and an aminopolycarboxylic acid, aminopolyphosphonic acid, phosphonocarboxylic acid or other chelating agent. Chelating agents may also be used in excess of the amount for forming the ferric ion complex salts. Among ferric complexes, the ferric complexes of aminopolycarboxylic acids are preferred, and the amount added is generally 0.01 to 1.0 mol/liter and preferably 0.05 to 0.50 mol/liter. In the bleaching solution, bleach-fixing solution and/or in a prebath, various compounds may be used as bleaching accelerators. Preferred examples, because of the superiority of their bleaching ability, include the compounds with a mercapto group or disulfide bond mentioned in U.S. Pat. No. 3,893,858, West German Patent 1,290,812, JP-A-53-95630 and *Research Disclosure*, No. 17129 (July, 1978), the thioureas mentioned in JP-B-45-8506, JP-A-52-20832 and JP-A-53-32735 and U.S. Pat. No. 3,706,561 or iodide, bromide ions and other such halides.

Further, bleach-fixing solutions which are used in the present invention can contain rehalogenating agents such as bromides (e.g., potassium bromide, sodium bromide, ammonium bromide) or chlorides (e.g., potassium chloride, sodium chloride, ammonium chloride) or iodides (e.g., ammonium iodide). If desired, it is also possible to add corrosion inhibitors consisting of one or more inorganic acids, organic acids and their alkali metal or ammonium salts with a pH buffering ability such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., or ammonium nitrate, guanidine, etc.

The fixing agents used in the bleach-fixing solution of the present invention are well-known watersoluble silver halide solvents such as thiosulfates such as sodium thiosulfate, ammonium thiosulfate, etc.; thiocyanates such as sodium thiocyanate, ammonium thiocyanate, etc.; thioethers such as ethylenebisglycolic acid, 3,6-dithia-1,8-octanediol, etc., and thioureas, etc., which can be used either singly or as a mixture of two or more. It is also possible to use a special bleach-fixing solution consisting of the fixing agent described in JP-A-55-155354 and a large amount of halide such as potassium iodide. In the present invention, the use of a thiosulfate, particularly ammonium thiosulfate, is preferred. The amount of fixing agent per liter of the solution used is preferably 0.3 to 3 mols and more preferably 0.5 to 2 mols. The preferable pH range of the bleaching and fixing solution of the present invention is preferably from 3 to 7, and particularly preferably from 5 to 7.

The bleach-fixing solution may contain, in addition, various fluorescent whiteners and defoaming agents or surfactants, organic solvents such as polyvinylpyrrolidone, methanol, etc.

As preservatives, the bleach-fixing solution of the present invention can contain a sulfite (e.g., sodium sulfite, potassium sulfite, ammonium sulfite, etc.), a bisulfite (e.g., ammonium bisulfite, sodium bisulfite, potassium bisulfite, etc.), a metabisulfite (e.g., potassium metabisulfite, sodium metabisulfite, ammonium metabisulfite, etc.) or other compound releasing sulfite ions or sulfones. Converted to sulfite ions, these compounds is preferably contained in an amount of from about 0.02 to 0.50 mol/liter and more preferably 0.04 to 0.40 mol/liter.

It is usual to add a sulfite as the preservative, but it is also possible to use ascorbic acid and carbonyl bisulfite adducts, carbonium compounds or the sulfinic acid compounds mentioned in Japanese Patent Application No. 63-136724, etc.

The addition is also possible of buffers, fluorescent whiteners, chelating agents, defoaming agents fungicides, etc., if desired.

In the bleach-fixing solution of the present invention, part or all of the overflow of the final bath, consisting of rinsing water and/or stabilizer, can be introduced. The amount is preferably 10 to 500 ml, more preferably 20 to 300 ml, and most preferably 30 to 200 ml, per $m^2$ of photosensitive material.

If the amount of rinsing water and/or stabilizer introduced is too small, the effect in reducing cost and reducing waste solution is also small, and if it is too large the bleach-fixing solution is diluted and the desilvering is unsatisfactory.

It is preferable for reducing waste solution that there is a maximum concentration of replenisher in the bleach-fixing solution of the present invention: that is, the optimal concentration of bleaching agent is 0.15 to 0.40 mol/liter and the optimal concentration of fixing agent is 0.5 to 2.0 mol/liter.

The amount of bleach-fixing replenisher is preferably 30 to 200 ml and more preferably 40 to 100 ml, per $m^2$ of photosensitive material. The bleaching agent and fixing agent may be replenished separately in the bleach-fixing replenisher.

The processing temperature of the bleach-fixing process of the present invention is generally from 20° C. to 50° C. and preferably from 30° C. to 40° C. The processing time is generally from 20 seconds to 2 minutes and preferably 30 seconds to 1 minute.

Water Rinsing (Water Washing) Process and/or Stabilizing Process

The water rinsing process and stabilizing process of the present invention are now described in detail. The amount of replenisher in the water rinsing or stabilizing process is generally from 1 to 50 times by volume, preferably from 2 to 30 times, and particularly preferably from 3 to 20 times, the amount supplied from the prebath per unit area of processed photosensitive material.

The amount of replenisher in the above water rinsing and/or stabilizing process can vary over a wide range depending on the characteristics of the photosensitive material (e.g., couplers, etc.) and its uses, the temperature, the mode of replenishment such as countercurrent or cocurrent, and other parameters. Of these, the relationship between the number of rinsing tanks and water amount in the multistage countercurrent method can be determined by the method described in the *Journal of the Society of Motion Picture and Television Engineers*, Vol. 64, pages 248 to 253 (May, 1955). Usually, the number of stages used in the multistage countercurrent method is preferably from 2 to 6 and particularly preferably from 2 to 4.

Consequently, the preferred amount of replenisher per square meter of photosensitive material in the two-tank countercurrent method is from 300 to 1,000 ml, in the three-tank countercurrent method from 100 to 500 ml and in the four-tank countercurrent method from 50 to 300 ml. The amount of carry-over of prebath components is about 20 to 60 ml per square meter of photosensitive material.

Various compounds may be added to the rinsing water of the present invention. Examples of the compounds include isothiazolones and thiabendazoles disclosed in JP-A-57-8542, chlorinated fungicides mentioned in JP-A-61-120145 such as sodium isocyanurate, benzotriazoles mentioned in JP-A-61-267761 and copper ions and also the bactericides described in *Bactericides and Fungicides* by Horiguchi, *Microorganisms Sterilization, Bactericidal and Fungicidal Techniques*, edited by the Health and Hygiene Technical Society, and *Dictionary of Bactericides & Fungicides*, edited by the Japanese Bactericidal and Fungicide Society.

In addition, it is possible to use a surfactant as a wetting agent and a chelating agent typified by EDTA as a hard water softening agent.

Processing can be carried out either following after the above rinsing process or directly in the stabilizing solution without going through the rinsing process. A compound with image stabilizing function is added to the stabilizing solution, e.g., an aldehyde compound typified by formalin, a buffer for adjusting the film pH suited to color stabilization or an ammonium compound. The aforementioned bactericides and fungicides may also be used for preventing the propagation of bacteria in the solution and conferring a fungicidal property on the photosensitive material after processing.

In addition, surfactants, fluorescent whiteners (i.e., brightening agents) and film hardening agents may be added. When, in the processing of the photosensitive materials of the present invention, the stabilization is direct without going through the water rinsing process, the methods described in JP-A-57-8543, JP-A-58-14834 and JP-A-60-220345, which are well-known methods, may all be used.

In addition, a preferred mode is the use of 1-hydroxyethylidene-1,1-diphosphonic acid, ethylenediaminetetramethylenephosphonic acid, or other such chelating agent and magnesium and bismuth compounds.

The water rinsing process of the present invention is also known as the water washing process.

In the present invention, it is preferable to reduce the concentration of calcium and magnesium in the replenisher during the water rinsing process and/or stabilization process to 5 mg/liter or less.

That is, by reducing the calcium and magnesium in the replenisher these metals are also, of course, reduced in the water washing (rinsing) tank and stabilizing tank, as a result of which the propagation of mold and bacteria is avoided without the special use of bactericides and fungicides, at the same time, doing away with staining of the conveyor roller and the squeegee blades of the automatic developing machine and adhesion of deposited matter.

In the present invention, the calcium and magnesium in the replenisher in the water rinsing process and/or stabilizing process (referred to below as rinsing replenisher or stabilizing replenisher) is, as mentioned above, preferably 5 mg/liter or less, more preferably 3 mg/liter or less, and particularly preferably 1 mg/liter or less.

Various well-known methods can be used for arranging so that the calcium and magnesium of the water rinsing or stabilizing replenisher are at this concentration and preferably ion exchange resins and/or reverse osmosis apparatus can be used.

Various cation exchange resins may be used for the above-mentioned ion exchange resins and preferably Na-type cation exchange resins which exchange Ca and Mg for Na can be used.

The H-type of cation exchange resins may also be used, but as in such cases the pH of the treated water becomes acidic, they should be used in combination with OH-type anion exchange resins.

Strongly acidic cation exchange resins can preferably be used, with a styrene-divinylbenzene copolymer as the substrate and a sulfo group as the ion exchange group. Examples of such ion, exchange resins which might be mentioned include the "Daiya ion SK-1B" or "Daiya ion PK-216" made by Mitsubishi Chemical Industries, Ltd. In the substrate of these ion exchange resins, the charging amount of divinylbenzene is preferably 4% to 16% of the charging amount of total monomer during production. The anion exchange resin which may be used in combinations with an H-type cation exchange resin is preferably a strongly basic anion exchange resin with a styrene-divinylbenzene copolymer substrate having a tertiary amine or quaternary ammonium group as the exchange group. Examples of such anion exchange resins which might be mentioned include "Daiya ion SA-10A" or "Daiya ion PA-418" similarly manufactured by Mitsubishi Chemical Industries, Ltd.

In the present invention, a reverse osmosis treatment apparatus may be used with the aim of reducing the amount of replenisher for the rinsing water and/or stabilizing solution.

In the present invention, there is no restriction on the reverse osmosis treatment apparatus which may be used but it is desirable to use an ultrasmall apparatus with a reverse osmosis membrane area of preferably 3 square meters or less with a pressure of 30 $kg/m^2$ or less, preferably 2 square meters or less with a pressure of 20 $kg/m^2$ or less. The operability is good and the water economy is satisfactory when such a small apparatus is used. Active carbon may also be used or magnetic fields, etc., may also be applied.

Reverse osmosis membranes for the reverse osmosis treatment apparatus which may be used include cellulose acetate membranes, ethyl cellulose/polyacrylate membranes, polyacrylonitrile membranes, polyvinylene carbonate membranes, polyethersulfone membranes, etc.

The liquid feed pressure usually employed is generally 5 to 60 $kg/cm^2$, but in order to achieve the aim of the present invention 30 $kg/cm^2$ or less is sufficient and even a low pressure reverse osmosis apparatus of 10 $kg/m^2$ or less is satisfactory for use.

The structure of the reverse osmosis membranes may be either spiral type, tubular type, hollow fiber type, pleated type or rod type.

In the present invention, it is also acceptable to irradiate at least one tank selected from the rinsing tank or the stabilizing tank or their replenishing tanks with UV rays, so inhibiting even further the growth of mold.

The UV lamp used in the present invention is a low pressure mercury vapor discharge tube with a line spectrum of wavelength 253.7 nm. The use in the present invention is particularly preferable of a lamp with a bactericidal output of 0.5 w to 7.5 w.

The UV lamp may either be sited outside the solution for irradiation purposes, or may irradiate from within the solution.

In the present invention, a bactericide or fungicide need not necessarily be used in the replenisher for water rinsing and/or stabilization, but if its use has no effect on the performance of the prebath, its use is optional.

The pH of the rinsing or stabilizing bath is usually from 4 to 9 and preferably from 5 to 8. However, in certain applications and for certain purposes, an acidic stabilizing bath in which acetic acid or the like has been added (pH 4 or less) is used.

The time of the rinsing or stabilizing process is now discussed.

The time of rinsing or stabilizing process in the present invention is from 10 seconds to 4 minutes, but a shorter time is preferred in that the effects of the present invention are better displayed, and is specifically from 20 seconds to 3 minutes and preferably from 20 seconds to 2 minutes.

Preferably various means for accelerating washing is combined in the rinsing or stabilizing stage. Such means of acceleration may include the ultrasonic wave vibration in the bath, air foaming, jet impact on the surface of the photosensitive material, compression by roller, etc. The temperature of the rinsing or stabilizing stage ranges generally from 20° C. to 50° C., preferably 25° C. to 45° C., and more preferably 30° C. to 40° C.

"Overflow" as applied to the rinsing and/or stabilizing stage means the liquid overflow outside the tank as replenishment proceeds. There are various methods of directing this overflow to the prebath. For example, either a slit can be made in the top of the wall adjacent the prebath in the automatic developer, or after the liquid has accumulated outside the automatic developing machine it can be supplied by the use of a pump.

By introducing the overflow into a prebath in this manner, the components of the bath can be maintained at the required concentration by adding small volumes of more concentrated replenisher to the prebath, and, as a result, the volume of waste water can be reduced by concentration of the prebath replenisher.

Naturally, the same effect is achieved by accumulating the overflow in the tank for preparing the solution and adding replenisher components to make up replenisher for use.

Furthermore, as a result of carry-over, the overflow will contain prebath components and by using these, it is possible to reduce the absolute amount of components replenished to the prebath, so lessening the pollution load and reducing the processing cost.

The amount of overflow introduced into the prebath can be set, if desired, for convenience in controlling the concentration of the prebath, but usually the ratio of mixed-in overflow in relation to the replenisher of the prebath is set at generally 0.2 to 5, preferably 0.3 to 3, and particularly preferably 0.5 to 2.

When adding the water rinsing replenisher or stabilizer replenisher as a substitute for the rinsing water to the color developing solution (bath) in the present invention, it is preferable that the replenisher does not contain any compound which releases ammonium ions, such as ammonium chloride and ammonia water. This is in order to avoid a reduction in photographic properties.

Next, specific processing stages of the present invention are mentioned, but the present invention is not restricted to such processes.

1 Color Development→Bleaching→(Water Rinsing)→Bleach-Fixing→(Water Rinsing)→(Stabilizing)

2. Color Development→Bleach-Fixing→(Water Rinsing)→(Stabilizing)

3. Color Development→Bleaching→Bleach-Fixing→(Water Rinsing)→(Stabilizing)

4. Color Development→Bleach-Fixing→(Water Rinsing)→(Stabilizing)

5. Color Development→Bleaching→Fixing→Bleach-Fixing→(Water Rinsing)→(Stabilizing)

6. Black & White Development→Water Rinsing→(Reversal)→Color Development→(Adjustment)→Bleaching→Bleach-Fixing→(Water Rinsing)→(Stabilizing)

7. Black & White Development→Water Rinsing→(Reversal)→Color Development→(Adjustment)→Bleach-Fixing→(Water Rinsing)→(Stabilizing)

8. Black & White Development→Water Rinsing→(Reversal)→Color Development→(Adjustment)→Bleaching→Bleach-Fixing→(Water Rinsing)

9. Color Development→Fixing→Bleach-Fixing→(Water Rinsing)

10. Color Development→Fixing→Bleach-Fixing→Bleach-Fixing→(Water Rinsing)

Stages in parentheses can be omitted, depending on the type of photosensitive material, the aim and the application, but water rinsing and stabilizing cannot be simultaneously omitted. The rinsing stage may be replaced by a stabilizing stage.

The method of the present invention may be applied to any processing stage. For example, it can be applied to the processing of color paper, color reversal paper, direct positive color photosensitive material, color positive film, color negative film, color reversal film, etc.

The silver halide color photographic material of the present invention is now described.

Any of the silver halides: silver bromide, silver iodobromide, silver iodochlorobromide, silver chlorobromide or silver chloride may be used for the photographic emulsion layers of the photographic material in the present invention.

The grains of silver halide in the photographic emulsion are so-called regular grains with a regular crystalline structure such as cubes, octahedra and tetradecahedra or irregular grains, e.g., spherical, etc., crystals with defects, such as twin crystal surfaces, or complex forms of these. Mixtures of grains of various crystal forms may also be used.

The silver halide grains may be fine grains having a grain size of about 0.1 μm or less, or large-sized grains having a projected surface area diameter of about 10 μm or more, and the emulsion may be a monodisperse emulsion with narrow distribution or a polydisperse emulsion with wide distribution.

The silver halide photographic emulsions which can be used in the present invention are produced by well-known methods, e.g., those described in *Research Disclosure*, Vol. 176, No. 17643 (December, 1978), pp. 22 and 23, "I. Emulsion Preparation & Types" and in *Research Disclosure*, Vol. 187, No. 18716 (November, 1979), p. 648.

The photographic emulsions of the present invention may be prepared by the methods described in P. Glafkides, *Chemie et Physique Photographique*, (Paul Montel, 1967), G. F. Duffin, *Photographic Emulsion Chemistry*, (Focal Press, 1966), V. L. Zelikman et al., *Making and Coating Photographic Emulsion*, (Focal Press, 964), etc. This is to say, either the acidic method, neutral method, ammonia method or the like may be used, and, as a method for reacting the soluble silver salts and soluble halides, either the single jet method, double jet method or a combination of these may be used. The method for forming the grains in an excess of silver ions (so-called reverse mixing method) may be used. One type of double jet method is to maintain a constant pAg in the liquid phase forming the silver halide, i.e., the so-called "controlled double jet method". This method produces a silver halide emulsion whose crystal form is regular and whose grain size is nearly uniform.

Physical ripening may be carried out in the presence of a well-known silver halide solvent (e.g., ammonia, potassium thiocyanate or the thioethers and thione compounds described in U.S. Pat. No. 3,271,157, JP-A-51-12360, JP-A-53-82408, JP-A-53-144319, JP-A-54-00717 or JP-A-54-155828). This method also produces silver halide grains whose crystal form is regular and whose grain size distribution is nearly uniform.

The above silver halide emulsions with regular grains are obtained by controlling the pAg and pH during formation of the grains. Details of this are given, for example, in *Photographic Science and Engineering*, Vol. 6, pp. 159 to 165 (1962), *Journal of Photographic Science*, Vol. 12, pp. 242 to 251 (1964), U.S. Pat. No. 3,655,394 and British Patent 1,413,748.

A typical monodisperse emulsion usable in the present invention has silver halide grains with an average grain size of above about 0.05 μm, with at least 95 we% within ±40% of the average grain size. In addition, it is possible to use emulsions in which the average grain size is from 0.15 to 2 μm, with at least 95 we% or at least 95% (number of grains) of the silver halide grains within ±20% of the average grain size. Methods of producing such emulsions are described in U.S. Pat. Nos. 3,574,628 and 3,655,394 and British Patent 1,413,748. Further, preferred examples of monodisperse emulsion are described in JP-A-48-8600, JP-A-51-39027, JP-A-51-83097, JP-A-53-137133, JP-A-54-48521, JP-A-54-99419, JP-A-58-37635, JP-A-58-49938, etc.

Tabular grains with an aspect ratio of 5 or more may be used in the present invention. Tabular grains may be simply prepared by the methods described in Gutoff, *Photographic Science and Engineering*, Vol. 14, pp. 248 to 257 (1970), U.S. Pat. Nos. 4,434,226, 4,414,310, 4,443,048 and 4,439,520 and in British Patent 2,112,157, etc. The use of tabular grains has the advantage of improved covering power and improved color sensitization efficiency due to sensitizing dyes; details are given in U.S. Pat. No. 4,434,226 referred to above.

By the use of sensitizing dyes and certain kinds of additives in the grain formation stage it is possible to use grains whose crystal form is controlled.

The crystal structure may be uniform or the inside and outside may have different halogen compositions, or the structure may be a layered structure. Emulsion grains of this kind have been disclosed in British Patent 1,027,146U.S. Pat. Nos. 3,505,068, 4,444,877, etc. Silver halides of different compositions may be joined by epitaxial junctions and may be joined with compounds other than silver halides, e.g., silver thiocyanate, lead oxide, etc. These emulsion grains are disclosed in U.S. Pat. Nos. 4,094,684, 4142,900 and 4,459,353, British Patent 2,038,792, U.S. Pat. Nos. 4,349,622, 4,395,478, 4,433,501, 4,463,087, 3,656,962 and 3,852,067 and JP-A-59-162540, etc.

In addition, it is possible to use a so-called internal latent image grain structure in which, after forming a sensitive nucleus ($Ag_2S$, AgN, Au, etc.) on the crystal surface by chemical ripening, silver halide is allowed to grow further around it.

In the process of silver halide grain formation or physical ripening, cadmium salts, zinc salts, lead salts, thallium salts, iridium salts or complex salts thereof, rhodium salts or complex salts thereof, iron salts, iron complex salts and the like may also be added.

For these various emulsions, either the surface latent image type in which the latent image forms mainly on the grain surface or the internal latent image type in which it forms inside the grain is suitable.

In addition, a direct reversal emulsion may be used. For the direct reversal emulsion, either the solarization type, internal latent image type, photofogging type or type using a nucleating agent may be used, or these may be used in combination.

Among these, it is preferable to use the internal latent image type which is not prefogged and to fog this with light either before or during processing or using a nucleating agent to obtain a direct positive image.

The internal latent image type silver halide emulsion which is not prefogged in the present invention is an emulsion in which the surface of the silver halide grain has not been prefogged and which contains silver halide forming a latent image mainly inside the grains.

More specifically, it is preferably a silver halide emulsion in which, when this emulsion is coated to a fixed amount onto a transparent support and this sample is subjected to a fixed-time exposure of from 0.01 to 10 seconds, the maximum density, as measured by a common photographic density measurement method, after developing for 6 minutes at 20° C. in the following Developing Solution A (internal developing solution) is preferably at least 5 times, and more preferably at least 10 times, the maximum density obtained when a similarly exposed sample is developed for 5 minutes at 18° C. in the following Developing Solution B (surface developing solution).

| | |
|---|---|
| Internal Developing Solution A: | |
| Metol | 2 g |
| Sodium Sulfite (anhydrous) | 90 g |
| Hydroquinone | 8 g |
| Sodium Carbonate (monohydrate) | 52.5 g |
| KBr | 5 g |
| KI | 0.5 g |
| Water to make | 1 liter |
| Internal Developing Solution B: | |
| Metol | 2.5 g |
| L-Ascorbic Acid | 10 g |
| $NaBO_2.4H_2O$ | 35 g |
| KBr | 1 g |

-continued

| | |
|---|---|
| Water to make | 1 liter |

Specific examples of the above internal latent image type emulsions which might be mentioned are the conversion type silver halide emulsions and core/shell type silver halide emulsions mentioned in British Patent 1,011,062 and U.S. Pat. Nos. 2,592,250 and 2.456,,943. The core/shell type silver halide emulsions are described in JP-A-47-32813, JP-A-47-32814, JP-A-52-134721, JP-A-52-156614, JP-A-53-60222, JP-A-53-66218, JP-A-53-66727, JP-A-55-127549, JP-A-57-136641, JP-A-58-70221, JP-A-59-208540, JP-A-59-216136, JP-A-60-107641, JP-A-60-247237, JP-A-61-2148, JP-A-61-3137, JP-B-56-18939, JP-B-58-1412, JP-B-58-1415, JP-B-58-6935, JP-A-58-108528, U.S. Pat. Nos. 3,206,313, 3,317,322, 3,761,266, 3,761,276, 3,850,637, 3,923,513, 4,035,185, 4,395,478, 4,504,570, European Patent 0,017,148, *Research Disclosure*, No. 16345 (November, 1977), etc.

For removing the soluble silver salts from the emulsion before and after physical ripening, noodle washing, precipitation due to flocculation or ultrafiltration, etc., can be used.

The emulsions used in the present invention have usually been physically ripened, chemically ripened and spectrally sensitized. Additives used for such processes are described in the aforementioned *Research Disclosure*, No. 17643 (December, 1978) and No. 18716 (November, 1979), the appropriate passages in these being summarized in the following table.

Photographic additives of a well-known kind which can be used in the present invention are also mentioned in the two aforementioned *Research Disclosure*, the appropriate passages being listed in the following table.

| Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers, Supersensitizers | Pages 23–24 | Page 648, right column to page 649, right column |
| 4. Brightening Agents | Page 24 | — |
| 5. Antifoggants and Stabilizers | Pages 24–25 | Page 649, right column |
| 6. Light Absorbers, Filter Dyes, Ultraviolet Absorbers | Pages 25–26 | Page 649, right column to page 650, left column |
| 7. Antistaining Agents | Page 25, right column | Page 650, left to right columns |
| 8. Dye Image Stabilizers | Page 25 | — |
| 9. Hardeners | Page 26 | Page 651, left column |
| 10. Binders | Page 26 | Page 651, left column |
| 11. Plasticizers, Lubricants | Page 27 | Page 650, right column |
| 12. Coating Aids, Surface Active Agents | Pages 26–27 | Page 650, right column |
| 13. Antistatic Agents | Page 27 | Page 650, right column |

In the present invention various color couplers may be used and specific examples are given in the patents mentioned in the aforementioned *Research Disclosure*, No. 17643, VII-C to G.

Preferred yellow couplers are those mentioned, for example, in U.S. Pat. Nos. 3,933,501, 4,022,620, 4,326,024, 4,401,752, JP-B-58-10739, British Patents 1,425,020, 1,476,760, etc.

Preferred magenta couplers are 5-pyrazolone and pyrazoloazole compounds, with special preference for those mentioned in U.S. Pat. Nos. 4,310,619 and 4,351,897, European Patent 73,636; U.S. Pat. Nos. 3,061,432, 3,725,067, *Research Disclosure*, No. 24220 (June. 1984), JP-A-60-33552, *Research Disclosure*, No. 24230 (June, 1984), JP-A-60-43659, U.S. Pat. Nos. 4,500,630, 4,540,654, etc.

As cyan couplers, phenolic and naphtholic couplers might be mentioned, preferably those described in U.S. Pat. Nos. 4,052,212, 4,146,396, 4,228,233, 4,296,200, 2,369,929, 2,801,171, 2,772,162, 2,895,826, 3,722,002, 3,758,308, 4,334,001, 4,327,173, West German Patent (Laid-Open) 3,329,729, European Patent 121,365A, U.S. Pat. Nos. 3,446,622, 4,333,999, 4,451,559, 4,427,767, European Patent 161,626A, etc.

Preferred colored couplers for correcting unnecessary absorption of color-forming dyes are those described in *Research Disclosure*, No. 17643, section VII–G, U.S. Pat. No. 4,163,670, JP-B-57-39413, U.S. Pat. Nos. 4,004,929, 4,138,258, British Patent 1,146,368, etc.

Preferred as couplers with suitable dispersibility of the color-forming dyes are those mentioned in U.S. Pat. No. 4,366,237, British Patent 2,125,570, European Patent 96,570, West German Patent (Laid-Open) 3,234,533.

Typical examples of polymerized dye-forming couplers are mentioned in U.S. Pat. Nos. 3,451,820, 4,080,211, 4,367,282 and British Patent 2,102,173.

Couplers which release photographically useful residual groups upon coupling are also preferred for use in the present invention. Preferred DIR couplers releasing development inhibitors are those mentioned in the patents mentioned in the aforementioned RD, 17643, VII-F and in JP-A-57-151944, JP-A-57-154234, JP-A-60-184248 and U.S. Pat. No. 4,248,962.

Preferred couplers which during development release nucleating agents or development accelerators in the form of an image are described in British Patents 2,097,140 and 2,131,188 and in JP-A-59-157638 and JP-A-59-170840.

Other couplers which may be used for the photosensitive material of the present invention are the competitive couplers mentioned in U.S. Pat. No. 4,130,427, etc., the polyequivalent couplers mentioned in U.S. Pat. Nos. 4,283,472, 4,338,393, 4,310,618, etc.; the DIR redox compounds or DIR couplers or couplers or redox releasing DIR couplers mentioned in JP-A-60-185950, JP-A-62-24252, etc.; the couplers releasing dyes which, after elimination, recover their color mentioned in European Patent 173,302A; the couplers releasing bleaching accelerators mentioned in RD, No. 11449, and RD, No. 24241, and JP-A-61-201247, etc.; and the ligand-releasing couplers mentioned in U.S. Pat. No. 4,553,477, etc.

The direct positive color photographic material of the present invention which uses an internal latent image type silver halide emulsion which has not been prefogged is preferably a type of positive photosensitive material in which fogging nuclei have been selectively formed by a chemical fogging method since this requires no complicated equipment in the automatic developing machine.

As nucleating agents which can be used in the present invention, any compounds developed earlier with the object of nucleating the internal latent image type silver halide are suitable. A combination of 2 or more nucleating agents may also be used. In greater detail, examples which might be mentioned are the quaternary heterocyclic compounds, hydrazine compounds, etc., mentioned in *Research Disclosure*, No. 22534 (January, 1983), pp. 50 to 54), No. 15162 (November, 1976, pp. 76 and 77) and No. 23510 (November, 1983, pp. 346 to 352).

These compounds are described in detail on pp. 372 to 375 of JP-A-63-74056.

The nucleating agent used in the present invention may be contained in the photosensitive material or in its processing solution, preferably in the photosensitive material itself.

When it is contained in the photosensitive material, it is preferably added to the internal latent image type silver halide emulsion layer, and if the nucleating agent is dispersed during coating or during processing and is adsorbed by the silver halide, it may also be added to another layer, e.g., an interlayer, undercoating layer and backing layer. Should the nucleating agent be added to the processing solution, it may be contained in the developing solution or in prebath having a low pH described in JP-A-58-178350.

When the nucleating agent is contained in the photosensitive material, the amount used is preferably $1\times10^{-8}$ to $1\times10^{-2}$ mol and more preferably $1\times10^{-7}$ to $1\times10^{-3}$ mol, per mol of silver halide.

When the nucleating agent is added to the processing solution, the amount used is preferably $1\times10^{-5}$ to $1\times10^{-1}$ mol and more preferably $1\times10^{-4}$ to $1\times20^{-2}$ mol, per liter.

The following compounds may be added with a view to raising the maximum image density, reducing the minimum image density, improving the preservability of the photosensitive material and accelerating development, etc.

Hydroquinones (e.g., the compounds mentioned in U.S. Pat. Nos. 3,227,552 and 4,279,987), chromans (e.g., those mentioned in U.S. Pat. No. 4,268,621, JP-A-54-103031, *Research Disclosure*, No. 18264, June, 1979, pp. 333 and 334), quinones (e.g., those mentioned in *Research Disclosure*, No. 21206, December, 1981, pp. 433 and 434), amines (e.g., those mentioned in U.S. Pat. No. 4,150,993 and JP-A-58-174757), oxidizing agents (e.g., those mentioned in JP-A-60-260039, *Research Disclosure*, No. 6936, May, 1978, pp. 10 and 11), catechols (e.g., those mentioned in JP-A-55-21013 and JP-A-55-65944), compounds releasing a nucleating agent during development (e.g., those mentioned in JP-A-60-107029), thioureas (e.g., those mentioned in JP-A-60-95533), spirobisindans (e.g., those mentioned in JP-A-55-65944).

As nucleating accelerators for use in the present invention, tetraazaindenes, triazaindenes and pentaazaindenes with at least one mercapto group optionally substituted by alkali metal atoms or ammonium groups, and the compounds mentioned in JP-A-61-136948 (pp. 2 to 6 and 16 to 43), and JP-A-63-106656 (pp. 12 to 43) and JP-A-63-8740 (pp. 10 to 29) can be mentioned.

The nucleating accelerators on this occasion is preferably added to the silver halide emulsion or the adjacent layer.

The amount of nucleating accelerator to be added is preferably from $1\times10^{-6}$ to $1\times10^{-2}$ mol and more preferably $1\times10^{-5}$ to $1\times10^{-2}$ mol, per mol of silver halide.

When the nucleating accelerator is added to the processing solution, i.e., the developing solution or its prebath, the amount is preferably from $1\times10^{-8}$ to $1\times10^{-3}$ mol and more preferably $1\times10^{-7}$ to $1\times10^{-4}$ mol, per liter.

2 or more nucleating accelerators may also be used.

EXAMPLES

The present invention is now specifically described by embodiments, although it is not restricted by these.

EXAMPLE 1

Multilayered printing paper having the multilayered structure shown below (Sample 101) was prepared on a paper support laminated with polyethylene on both sides. The coating solutions were prepared as follows.

Preparation of first layer coating solution: 27.2 ml of ethyl acetate and 4.1 g each of solvent 3 (Solv-3) and solvent 6 (Solv-6) were added to 19.1 g of yellow coupler (ExY-1), 4.4 g of color image stabilizer (Cpd-14) and 1.8 g of (Cpd-6) to dissolve them, and this solution was emulsified and dispersed in 185 ml of 10 wt% gelatin aqueous solution containing 8 ml of 10 wt% sodium dodecylbenzenesulfonate. While, $5.0\times10^{-4}$ mol per mol of Ag of the blue-sensitive sensitizing dye mentioned below was added to a sulfur-sensitized silver halide emulsion (mixture of 80.0 mol% silver bromide content, cubic, average grain size 0.85 μm, variation coefficient 0.08; and 80.0 mol% silver bromide content, cubic, average grain size 0.62 μm, variation coefficient 0.07, in an Ag molar ratio of 1 to 3). The above emulsified dispersion and this emulsion were mixed and dissolved so as to prepare the first coating solution of the composition shown below.

The coating solutions for the second to seventh layers were prepared by the same method as the first layer coating solution.

As a gelatin hardening agent for the various layers, sodium 1-oxy-3,5-dichloro-s-triazine was used.

The following compounds were used as spectrally sensitizing dyes for the various layers.

Blue-Sensitive Emulsion Layer:

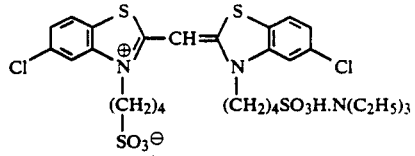

($5.0\times10^{-4}$ mol per mol of emulsion)

Green-Sensitive Emulsion Layer:

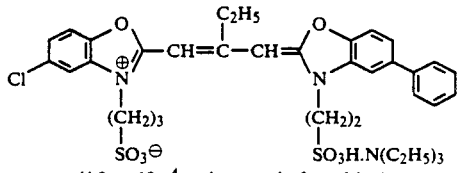

($4.0\times10^{-4}$ mol per mol of emulsion)

and

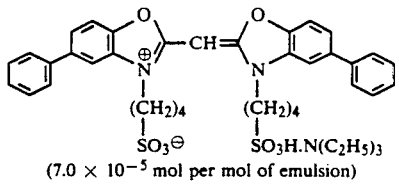

($7.0\times10^{-5}$ mol per mol of emulsion)

Red-Sensitive Emulsion Layer

-continued

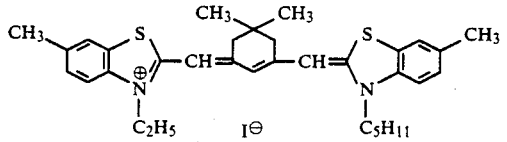

(0.9 × $10^{-4}$ mol per mol of emulsion)

The following compound was added as a spectral sensitizing dye to the red-sensitive emulsion layer at the rate of $2.6\times10^{-3}$ mol per mol of silver halide.

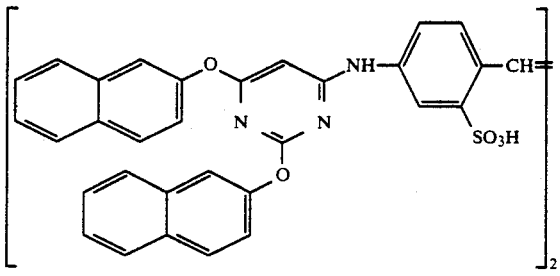

1-(5-Methylureidophenyl)-5-mercaptotetrazole was added to the blue-sensitive, green-sensitive and red-sensitive emulsion layers, respectively in ratios of $4.0\times10^{-6}$ mol, $3.0\times10^{-5}$ mol and $1.0\times10^{-5}$ mol, per mol of silver halide, and 2-methyl-5-octylhydroquinone respectively in ratios of $8.0\times10^{-3}$ mol, $2.0\times10^{-2}$ mol and $2.0\times10^{-2}$ mol, per mol of silver halide.

Also, 4-hydroxy-6-methyl-1,3,3a,7-tetra-azaindene was added to the blue-sensitive emulsion layer and green-sensitive emulsion layer, respectively in ratios of $1.0\times10^{-2}$ mol and $1.1\times10^{-2}$ mol, per mol of silver halide. In addition, the following dyes were added to prevent irradiation:

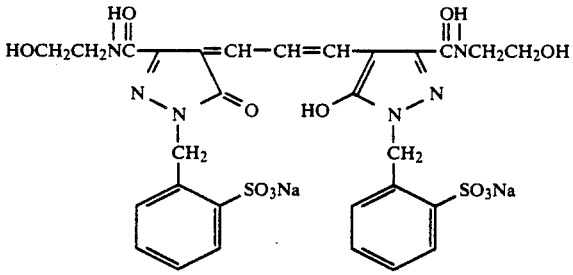

and

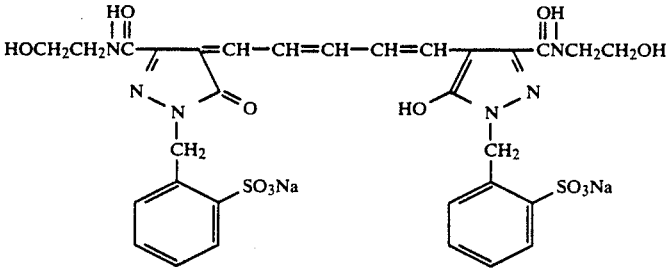

Layer Structure

The compositions of the various layers are shown below. The figures represent the coated amount in g/m². The amount of silver halide coated is shown converted to silver.

Support

Paper Support Laminated on Both Sides with Polyethylene (the polyethylene side of the first layer contains a white pigment ($TiO_2$) and bluish dye (ultramarine))

| | |
|---|---|
| First Layer: Blue-Sensitive Layer | |
| The Above-Mentioned Silver Chlorobromide Emulsion (AgBr content: 80 mol %) | 0.26 |
| Gelatin | 1.83 |
| Yellow Coupler (ExY-1) | 0.83 |
| Color Image Stabilizer (Cpd-14) | 0.19 |
| Color Image Stabilizer (Cpd-6) | 0.08 |
| Solvent (Solv-3) | 0.18 |
| Solvent (Solv-6) | 0.18 |
| Second Layer: Color Mixing Prevention Layer | |
| Gelatin | 0.99 |
| Anti-Color-Mixing Agent (Cpd-9) | 0.08 |
| Solvent (Solv-1) | 0.16 |
| Solvent (Solv-4) | 0.08 |
| Third Layer: Green-Sensitive Layer | |
| Silver Chlorobromide Emulsion (AgBr content: 90 mol %, cubic, average grain size: 0.47 μm, variation coefficient: 0.12 and AgBr content: 90 mol %, cubic, average grain size: 0.36 μm, variation coefficient: 0.09, mixed in 1/1 ratio (Ag molar ratio)) | 0.14<br>0.47 |
| Gelatin | 1.79 |
| Magenta Coupler (ExM) | 0.32 |
| Color Image Stabilizer (Cpd-3) | 0.20 |
| Color Image Stabilizer (Cpd-10) | 0.03 |
| Color Image Stabilizer (Cpd-12) | 0.04 |
| Solvent (Solv-2) | 0.65 |
| Fourth Layer: UV-Absorbing Layer | |
| Gelatin | 1.58 |
| UV Absorber (UV-1) | 0.47 |
| Anti-Color-Mixing Agent (Cpd-9) | 0.05 |
| Solvent (Solv-5) | 0.24 |
| Fifth Layer: Red-Sensitive Layer | |
| Silver Chlorobromide Emulsion (AgBr content: 70 mol %, cubic, average grain size: 0.49 μm, variation coefficient: 0.08, and AgBr content: 70 mol %, cubic, average grain size: 0.34 μm, variation coefficient: 0.10, mixed in ½ ratio (Ag molar ratio)) | 0.23 |

-continued

| | |
|---|---|
| Gelatin | 1.34 |
| Cyan Coupler (ExC) | 0.30 |
| Color Image Stabilizer (Cpd-2/Cpd-1/Cpd-16 in 2/4/4 mixture) | 0.17 |
| Color Image Stabilizer (Cpd-6) | 0.40 |
| Color Image Stabilizer (Cpd-15) | 0.04 |
| Solvent (Solv-6) | 0.20 |
| Sixth Layer: UV-Absorbing Layer | |
| Gelatin | 0.53 |
| UV Absorber (UV-1) | 0.16 |
| Anti-Color-Mixing Agent (Cpd-9) | 0.02 |
| Solvent (Solv-5) | 0.08 |
| Seventh Layer: Protective Layer | |
| Gelatin | 1.33 |
| Acrylic-Modified Copolymer of Polyvinyl Alcohol (17% modified) | 0.17 |
| Liquid Paraffin | 0.03 |

(UV-1) UV-Absorber

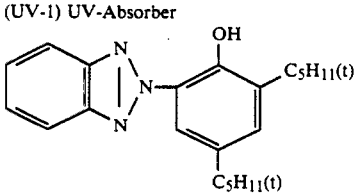

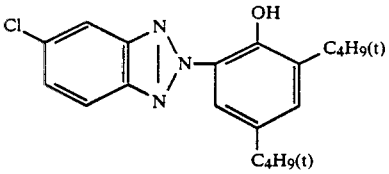

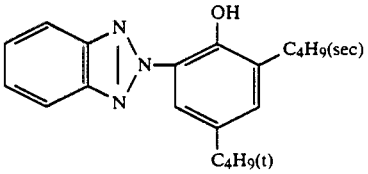

in 4/2/4 mixture (by weight)

(Solv-1) Solvent

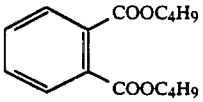

(Solv-2) Solvent

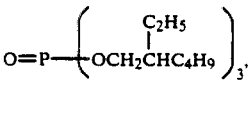

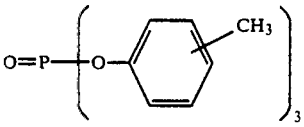

in 2/1 mixture (by volume)

(Solv-3) Solvent $O{=}P(O{-}C_9H_{19}(iso))_3$ (Solv-4) Solvent

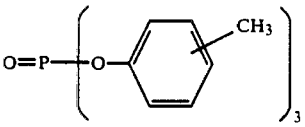

(Solv-5) Solvent $COOC_8H_{17}$
|
$(CH_2)_8$
|
$COOC_8H_{17}$ (Solv-6) Solvent $C_8H_{17}CHCH(CH_2)_7COOC_8H_{17}$
$\backslash\ /$
$O$ (ExM) Magenta Coupler

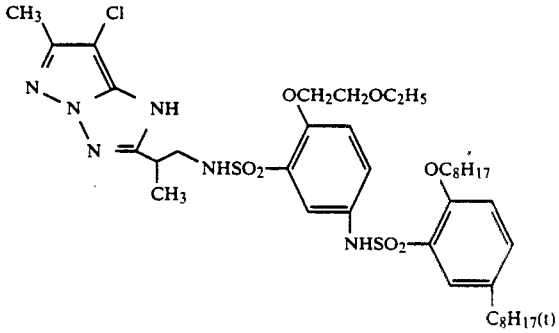

(ExC) Cyan Coupler

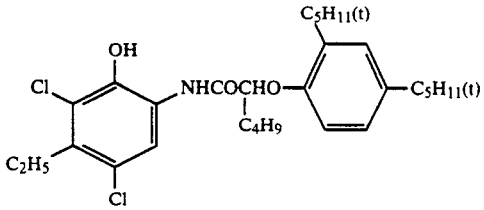

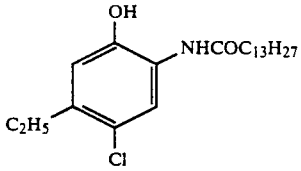

1/1 mixture (molar ratio)

(ExY-1)

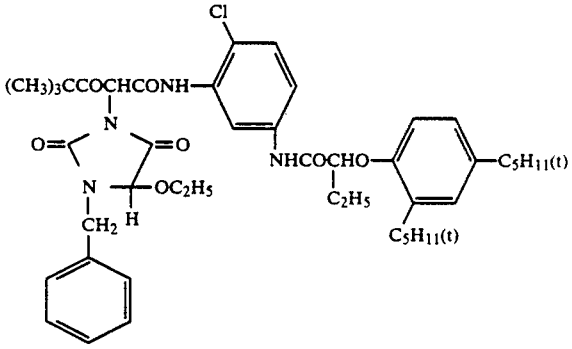

Color Image Stabilizer (Cpd-1)

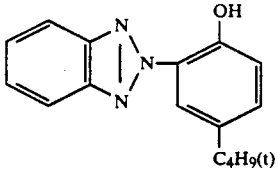

Color Image Stabilizer (Cpd-2)

-continued

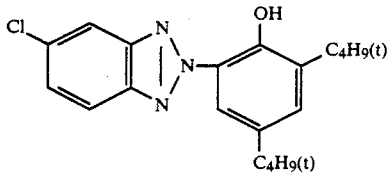

Color Image Stabilizer (Cpd-3)

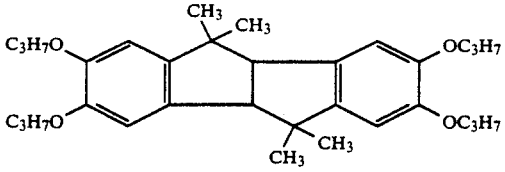

Color Image Stabilizer (Cpd-6)

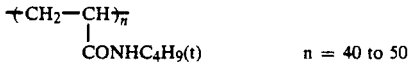

n = 40 to 50

Average molecular weight: about 60,000

Anti-Color-Mixing Agent (Cpd-9)

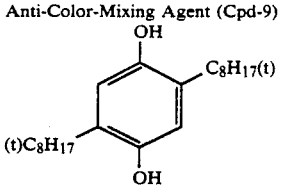

Color Image Stabilizer (Cpd-10)

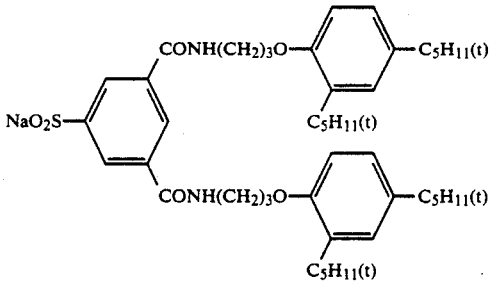

Color Image Stabilizer (Cpd-12)

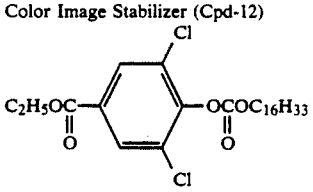

Color Image Stabilizer (Cpd-14)

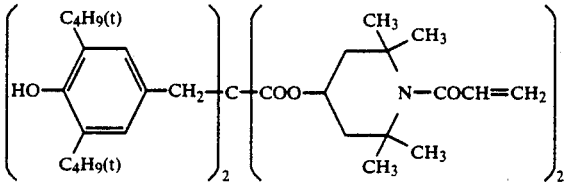

Color Image Stabilizer (Cpd-15)

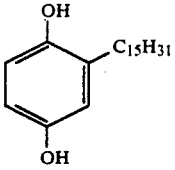

-continued

Color Image Stabilizer (Cpd-16)

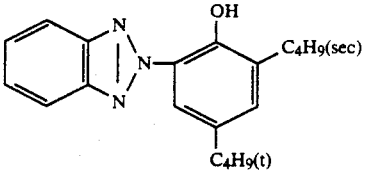

After the imagewise exposure of Sample 101 obtained in the above manner, continuous processing was carried out in the automatic developing machine until the cumulative replenishment amount of the color developing solution was 'times the tank volume. The amount processed was 5 $m^2$ daily. The processing stages are shown below.

| Processing Stage | | Processing A Temperature (°C.) | Time (sec) | Replenishment Amount (ml) | Tank Capacity (liter) |
|---|---|---|---|---|---|
| Color Development | P1 | 35 | 45 | 80 | 10 |
| Bleach-Fixing | P2 | 30-36 | 45 | 60 | 10 |
| Rinsing (1) | PS1 | 30-37 | 20 | — | 5 |
| Rinsing (2) | PS2 | 30-37 | 20 | — | 5 |
| Rinsing (3) | PS3 | 30-37 | 20 | — | 5 |
| Rinsing (4) | PS4 | 30-37 | 30 | 100 | 5 |
| Drying | | 70-85 | 60 | | |

The above replenishment amounts represent the amount of replenisher per square meter of photosensitive material. As shown by the arrows in the Figure, there is a countercurrent replenishment method in which the rinsing water overflow is brought into the prebath, and the overflow of rinsing water (1) is brought into the bleach-fixing solution.

Continuous processing was conducted indoors at a room temperature of 20° C., humidity of 75%, and $CO_2$ gas concentration of 1,200 ppm. The open area value of the automatic developing machine used for the experiment was 0.02 $cm^2$/ml and the amount of daily evaporation was 60 ml. The operational time on this occasion was 10 hours.

The composition of the various processing solutions was as follows.

| | Tank Solution | Replenisher |
|---|---|---|
| Color Developing Solution: | | |
| Water | 800 ml | 800 ml |
| Ethylenediaminetetraacetic Acid | 5.0 g | 5.0 g |
| Sodium 5,6-Dihydroxybenzene-1,2,4-trisulfonate | 0.3 g | 0.3 g |
| Sodium Chloride | 4 g | — |
| Potassium Carbonate | 25 g | 25 g |
| N-Ethyl-N-(β-methanesulfonamidoethyl)-3-methyl-4-aminoaniline Sulfate | 5.0 g | 10.0 g |
| Preservative A (see Table 1) | 0.03 mol | 0.05 mol |
| Preservative B (see Table 1) | 0.04 mol | 0.04 mol |
| Fluorescent Whitener (4,4'- | 2.0 g | 4.5 g |

-continued

| | | |
|---|---|---|
| diaminostilbene based) | | |
| Water to make | 1,000 ml | 1,000 ml |
| pH (25° C.) | 10.05 | 10.85 |
| Bleach-Fixing Solution (tank solution and replenisher are the same) | | |
| Water | | 400 ml |
| Ammonium Thiosulfate (70 wt % aq. soln.) | | 200 ml |
| Sodium p-Methylsulfinate | | 25 g |
| Sodium Sulfite | | 20 g |
| Ferric Ammonium Ethylenediaminetetra-acetate | | 100 g |
| Disodium Ethylenediaminetetraacetate | | 5 g |
| Glacial Acetic Acid | | |
| Water to make | | 1,000 ml |
| pH (25° C.) | | 5.80 |
| Rinsing Water (tank solution and replenisher are the same) | | |

Tap water was passed through a mixed bed column packed with H-type strongly basic cation exchange resin ("Amberlite IR-120B" made by Rohm & Haas) and OH-type anion exchange resin ("Amberlite IR-400", made by Rohm & Haas), producing water of the following quality:

| | |
|---|---|
| Calcium | 0.3 mg/liter |
| Magnesium | 0.1 mg/liter or less |
| pH | 6.5 |
| Conductivity | 5.0 μS/cm |

Next, at the end of one day's treatment, 40 ml at a time of rinsing water replenisher was run over the conveyor rollers over the solution surface in the color developing bath in order to clean them, the remainder of the continuous processing was carried out by the same manner as in Processing A (Processing B).

Next, at the end of one day's treatment, 20 ml at a time of rinsing water replenisher was run over the set of 4 conveyor rollers over the solution surfaces in the bleach-fixing bath and/or first rinsing bath, the remainder of the continuous processing was carried out by the same manner as in Processing B (Processing C).

Next, replenishment was carried out by running rinsing water replenisher (20 ml) over the conveyor rollers at the outlet of the third rinsing bath, the remainder of the continuous processing was carried out by the same manner as in Processing C (Processing D).

Next, the pH of the bleach-fixing solution of Processing D (mother liquor, replenisher) was varied and the remainder of continuous processing was carried out by the same manner as in Processing D (Processing E).

In Processing A and Processing B, the change in the speed ($\Delta S_{1.0}$) of a magenta image before and after continuous processing was investigated, also an investigation was made as to whether or not stains and scratches were present on the photosensitive material when, after continuous processing, the automatic developing machine was stopped for 2 days and then further processing was carried out.

With respect to Processings A, B, C, D and E the presence or absence of the above stains and scratches due to processing was examined, and in addition the sample after continuous processing was kept at 80° C. and 70% humidity for 2 days and the change in the minimum density of the magenta (ΔDmin) was examined. The results are shown in Tables 1 and 2.

TABLE 1

| No. | Processing | CD Preservative A | CD Preservative B | Roller Washing P1 | Roller Washing P2 | Roller Washing PS1 | Rinsing Water Roller Replenishment | $\Delta S_{1.0}(GL)$ | Processing Scratches | Remarks |
|---|---|---|---|---|---|---|---|---|---|---|
| 1 | A | Comparative Compound | Nothing | — | — | — | — | +0.15 | B | Comparison |
| 2 | " | Comparative Compound | " | Adding water only | — | — | — | +0.10 | B | " |
| 3 | B | Comparative Compound | " | ∘ | — | — | — | +0.10 | B | " |
| 4 | A | Illustrative Compound I-1 | Illustrative Compound III-1 | Adding water only | — | — | — | +0.10 | B | " |
| 5 | B | Illustrative Compound I-1 | Illustrative Compound III-1 | ∘ | — | — | — | +0.05 | G | Invention |
| 6 | " | Illustrative Compound I-6 | Illustrative Compound IV-1 | ∘ | — | — | — | +0.06 | G | " |
| 7 | " | Illustrative Compound II-7 | Illustrative Compound IV-7 | ∘ | — | — | — | +0.04 | G | " |
| 8 | " | Illustrative Compound II-7 | Illustrative Compound III-1 | ∘ | — | — | — | +0.03 | G | " |
| 9 | " | Illustrative Compound II-30 | Illustrative Compound IV-1 | ∘ | — | — | — | +0.05 | G | " |
| 10 | " | Illustrative Compound II-45 | Illustrative Compound IV-7 | ∘ | — | — | — | +0.06 | G | " |
| 11 | " | Illustrative Compound II-71 | Illustrative Compound III-16 | ∘ | — | — | — | +0.04 | G | " |

TABLE 2

| No. | Processing | CD Preservative A | CD Preservative B | Roller Washing P1 | Roller Washing P2 | Roller Washing PS1 | Rinsing Water Roller Replenishment | ΔDmin (GL) | Processing Staining | Remarks |
|---|---|---|---|---|---|---|---|---|---|---|
| 12 | A | Illustrative Compound I-1 | Illustrative Compound III-1 | — | — | — | — | 0.25 | BB | Comparison |
| 13 | " | Illustrative Compound I-1 | Illustrative Compound III-1 | Adding water only | — | — | — | 0.24 | BB | " |
| 14 | B | Illustrative Compound I-1 | Illustrative Compound III-1 | ∘ | — | — | — | 0.20 | M | Invention |
| 15 | C | Illustrative Compound I-1 | Illustrative Compound III-1 | ∘ | ∘ | ∘ | — | 0.10 | G-M | " |
| 16 | D | Illustrative Compound I-1 | Illustrative Compound III-1 | ∘ | ∘ | ∘ | ∘ | 0.09 | G | " |
| 17 | A | Illustrative Compound II-7 | Illustrative Compound III-1 | — | — | — | — | 0.24 | BB | Comparison |
| 18 | B | Illustrative Compound II-7 | Illustrative Compound III-1 | ∘ | — | — | — | 0.18 | M | Invention |
| 19 | C | Illustrative Compound II-7 | Illustrative Compound III-1 | ∘ | ∘ | ∘ | — | 0.11 | M-G | " |
| 20 | D | Illustrative Compound II-7 | Illustrative Compound III-1 | ∘ | ∘ | ∘ | ∘ | 0.08 | G | " |
| 21 | E | Illustrative Compound II-7 | Illustrative Compound III-1 | ∘ | ∘ | ∘ | ∘ | 0.17 | G | " |

In Tables 1 and 2, those processing baths whose rollers were cleaned with rinsing water replenisher are marked with o. As regards scratches and stains from processing, cases where this was considerable are marked with BB and those where it did not occur are marked with G, intermediate levels being shown by B-M-G.

In Nos. 2 and 12, 40 ml of distilled water was added directly to the color developing bath at the end of one day's treatment without cleaning the rollers.

It is clearly seen from the results of Tables 1 and 2 that by the processing method of the present invention there was little change in photographic performance and a preferable result with no processing stains or scratches was obtained In the treatment of No. 20, the continuous processing was carried out, with a pH of 7.10 in the bleach-fixing solution and there was a slight deterioration in the image preservability of the sample after processing.

EXAMPLE 2

Preparation of Direct Positive Color Photographic Material

A color photographic material (Sample 201) was prepared by coating the following first to fourteenth layers onto the front of a paper support laminated on both sides with polyethylene 100 μm thick) and fifteenth and sixteenth layers onto the back of the support. The first coating layer of polyethylene contained titanium white as a white pigment and a little ultramarine as a bluish dye.

Composition of Photosensitive Layers

The composition and coated amounts in g/m$^2$ units are shown below. The amount of silver halide coated is shown converted to silver. The emulsions used for the various layers were prepared by the production method for Emulsion EM1. However, the emulsion of fourteenth layer was a Lippmann emulsion with no surface chemical sensitization.

| | |
|---|---|
| First Layer: Antihalation Layer | |
| Black Colloidal Silver | 0.10 |
| Gelatin | 1.30 |
| Second Layer: Interlayer | |
| Gelatin | 0.70 |
| Third Layer: Low Speed Red-Sensitive Layer | |
| Silver Bromide Spectrally Sensitized with Red-Sensitizing Dye (ExS-1, ExS-2, ExS-3) (average grain size: 0.3 μm, size distribution (variation coefficient): 8%, octahedral) | 0.06 |
| Silver Chlorobromide Spectrally Sensitized with Red-Sensitizing Dye (ExS-1, ExS-2, ExS-3) (silver chloride content: 5 mol %, average grain size: 0.45 μm, size distribution: 10%, octahedral) | 0.10 |
| Gelatin | 1.00 |
| Cyan Coupler (ExC-1) | 0.11 |
| Cyan Coupler (ExC-2) | 0.10 |
| Cyan Coupler (ExC-3) | 0.01 |
| DAR Coupler (ExD-1) | $3 \times 10^{-4}$ |
| Anti-Color-Fading Agent (Cpd-2, Cpd-3, Cpd-4, Cpd-13 equal amounts) | 0.12 |
| Coupler Dispersing Medium (Cpd-5) | 0.03 |
| Coupler Solvent (Solv-7, Solv-2, Solv-3 equal amounts) | 0.06 |
| Fourth Layer: High Speed Red-Sensitive Layer | |
| Silver Bromide Spectrally Sensitized with Red-Sensitizing Dye (ExS-1, ExS-2, ExS-3) (average grain size: 0.60 μm, size distribution: 15%, octahedral) | 0.14 |
| Gelatin | 1.00 |
| Cyan Coupler (ExC-1) | 0.15 |
| Cyan Coupler (ExC-2) | 0.15 |
| Cyan Coupler (ExC-3) | 0.01 |
| DAR Coupler (ExD-1) | $2 \times 10^{-4}$ |

-continued

| | |
|---|---|
| Anti-Color-Fading Agent (Cpd-2, Cpd-3; Cpd-4, Cpd-13 equal amounts) | 0.15 |
| Coupler Dispersing Medium (Cpd-5) | 0.03 |
| Coupler Solvent (Solv-7, Solv-2, Solv-3 equivalent) | 0.10 |
| Fifth Layer: Interlayer | |
| Gelatin | 1.00 |
| Anti-Color-Mixing Agent (Cpd-7) | 0.08 |
| Anti-Color-Mixing Agent Solvent (Solv-4, Solv-5 equal amounts) | 0.16 |
| Polymer Latex (Cpd-8) | 0.10 |
| Sixth Layer: Low Speed Green-Sensitive Layer | |
| Silver Bromide Spectrally Sensitized with Green-Sensitizing Dye (ExS-3) (average grain size: 0.25 μm, grain size distribution: 8%, octahedral) | 0.04 |
| Silver Bromide Spectrally Sensitized with Green-Sensitizing Dye (ExS-3, ExS-4) (average grain size: 0.45 μm, grain size distribution: 11%, octahedral) | 0.06 |
| Gelatin | 0.80 |
| Magenta Coupler (ExM-1, ExM-2, equal amounts) | 0.11 |
| Magenta Coupler (ExM-3) | 0.01 |
| DAR Coupler (ExD-1) | $3 \times 10^{-4}$ |
| Anti-Color-Fading Agent (Cpd-9) | 0.10 |
| Anti-Staining Agent (Cpd-10, Cpd-22 equal amounts) | 0.014 |
| Anti-Staining Agent (Cpd-23) | 0.001 |
| Anti-Staining Agent (Cpd-12) | 0.01 |
| Coupler Dispersing Medium (Cpd-5) | 0.05 |
| Coupler Solvent (Solv-4, Solv-6 equal amounts) | 0.15 |
| Seventh Layer: High Speed Green-Sensitive Layer | |
| Silver Bromide Spectrally Sensitized with Green-Sensitizing Dye (ExS-3, ExS-4) (average grain size: 0.8 μm, grain size distribution: 16%, octahedral) | 0.10 |
| Gelatin | 0.80 |
| Magenta Coupler (ExM-1, ExM-2) | 0.11 |
| Magenta Coupler (ExM-3) | 0.01 |
| DAR Coupler (ExD-1) | $1 \times 10^{-4}$ |
| Anti-Color-Fading Agent (Cpd-9) | 0.10 |
| Anti-Staining Agent (Cpd-10, Cpd-22 equal amounts) | 0.013 |
| Anti-Staining Agent (Cpd-23) | 0.001 |
| Anti-Staining Agent (Cpd-12) | 0.01 |
| Coupler Dispersing Medium (Cpd-5) | 0.05 |
| Coupler Solvent (Solv-4, Solv-6 equal amounts) | 0.15 |
| Eighth Layer: Interlayer | |
| Same as Fifth Layer | |
| Ninth Layer: Yellow Filter Layer | |
| Yellow Colloidal Silver | 0.20 |
| Gelatin | 1.00 |
| Anti-Color-Mixing Agent (Cpd-7) | 0.06 |
| Anti-Color-Mixing Agent Solvent (Solv-4, Solv-5 equal amounts) | 0.15 |
| Polymer Latex (Cpd-8) | 0.10 |
| Tenth Layer: Interlayer | |
| Same as Fifth Layer | |
| Eleventh Layer: Low Speed Blue-Sensitive Layer | |
| Silver Bromide Spectrally Sensitized with Blue-Sensitizing Dye (ExS-5, ExS-6) (average grain size: 0.45 μm, grain size distribution: 8%, octahedral) | 0.07 |
| Silver Bromide Spectrally Sensitized with Blue-Sensitizing Dye (ExS-5, ExS-6) (average grain size: 0.60 μm, grain size distribution: 14%, octahedral) | 0.10 |
| Gelatin | 0.50 |
| Yellow Coupler (ExY-1) | 0.22 |
| Yellow Coupler (ExY-2) | 0.01 |
| DAR Coupler (ExD-1) | $2 \times 10^{-4}$ |
| Anti-Staining Agent (Cpd-11) | 0.001 |
| Anti-Color-Fading Agent (Cpd-6) | 0.10 |
| Coupler Dispersion Medium (Cpd-5) | 0.05 |
| Coupler Solvent (Solv-2) | 0.05 |
| Twelfth Layer: High Speed Blue-Sensitive Layer | |
| Silver Bromide Spectrally Sensitized with Blue-Sensitizing Dye (ExS-5, ExS-6) (average grain size: 1.2 μm, grain size distribution: 21%, octahedral) | 0.25 |
| Gelatin | 1.00 |
| Yellow Coupler (ExY-1) | 0.41 |
| Yellow Coupler (ExY-2) | 0.02 |
| DAR Coupler (ExD-1) | $3 \times 10^{-4}$ |
| Anti-Staining Agent (Cpd-11) | 0.002 |
| Anti-Color-Fading Agent (Cpd-6) | 0.10 |
| Coupler Dispersion Medium (Cpd-5) | 0.05 |
| Coupler Solvent (Solv-2) | 0.10 |
| Thirteenth Layer: UV-Absorbing Layer | |
| Gelatin | 1.50 |
| UV-Absorbing Agent (Cpd-1, Cpd-3, Cpd-13 equal amounts) | 1.00 |
| Anti-Color-Fading Agent (Cpd-6, Cpd-14 equal amounts) | 0.06 |
| Dispersion Medium (Cpd-5) | 0.05 |
| UV-Absorbing Solvent (Solv-1, Solv-2 equal amounts) | 0.15 |
| Dye for Preventing Irradiation (Cpd-15, Cpd-16 equal amounts) | 0.02 |
| Dye for Preventing Irradiation (Cpd-17, Cpd-18 equal amounts) | 0.02 |
| Fourteenth Layer: Protective Layer | |
| Silver Chlorobromide Micrograins (silver chloride content: 97 mol %, average size: 0.2 μm) | 0.05 |
| Acrylic-Modified Copolymer of Polyvinyl Alcohol (degree of modification: 17%) | 0.02 |
| Polymethyl Methacrylate Grains (average grain size: 2.4 μm), Silicon Oxide (average grain size: 5 μm) (equal amounts) | 0.05 |
| Gelatin | 1.50 |
| Gelatin Hardener (H-1) | 0.17 |
| Fifteenth Layer: Backing Layer | |
| Gelatin | 2.50 |
| Black Colloidal Silver | 0.25 |
| Sixteenth Layer: Protective Layer for Back Surface | |
| Polymethyl Methacrylate Grains (average grain size: 2.4 μm), Silicon Oxide (average grain size: 5 μm) (equal amounts) | 0.05 |
| Gelatin | 2.00 |
| Gelatin Hardener (H-2) | 0.11 |

Method of Preparing Emulsion EM1

Silver bromide octahedral grains having an average grain size of 0.40 μm were obtained by adding aqueous solutions of potassium bromide and silver nitrate simultaneously for 15 minutes at 75° C. to an aqueous solution of gelatin while stirring vigorously. Chemical sensitization was performed on this emulsion by gradually adding, per mol of silver, 0.3 g of 3,4-dimethyl-1,3-thiazoline-2-thione, 4 mg of sodium thiosulfate and 5 mg of chloroauric acid (tetrahydrate) with heating to 75° C. for 80 minutes. With grains obtained in this manner as the core, further growth was carried out under the same precipitation environment as the first time, finally obtaining a monodisperse octahedral core/shell silver bromide emulsion having 0.65 μm average grain size. The variation coefficient of grain size was about 10% Chemical sensitization of this emulsion by the addition, per mol of silver, of 1.0 mg of sodium thiosulfate and 1.5 mg of chloroauric acid (tetrahydrate) with heating to 60° C. for 45 minutes produced an internal latent image type silver halide emulsion.

In each photosensitive layer, $5.2 \times 10^{-6}$ mol of ExZK-1 as a nucleating agent and $1.3 \times 10^{-4}$ mol of the nucleating accelerator Cpd-22 were used per mol of coated silver halide. Further, compounds used for each layer were Alkanol XC (Du Pont) and sodium alkylbenzenesulfonate as emulsion dispersing aids and succinic acid ester and Magefac F-120 (Dai Nippon Ink Co., Ltd.) as coating aids. Cpd-19, Cpd-20, Cpd-21 were used as stabilizers for the layers containing silver halide and colloidal silver. The compounds used in this example are listed below.
ExS-1
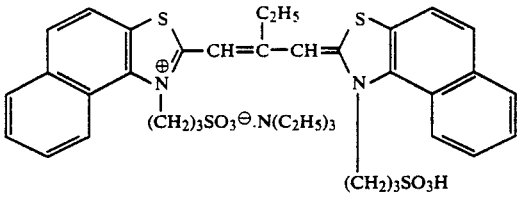
ExS-2
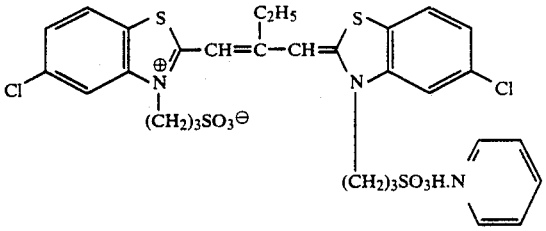
ExS-3
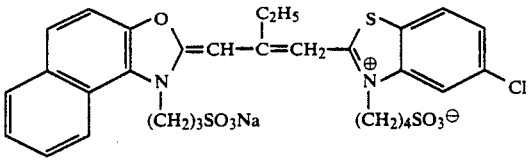
ExS-4
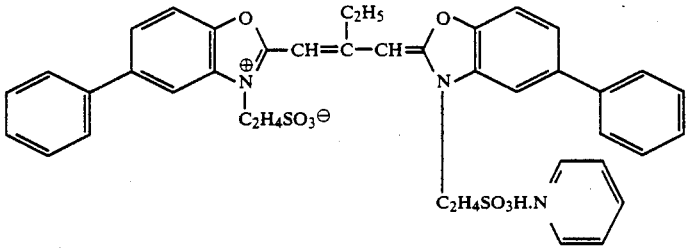
ExS-5
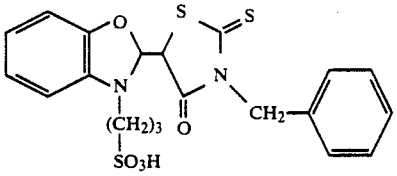
ExS-6
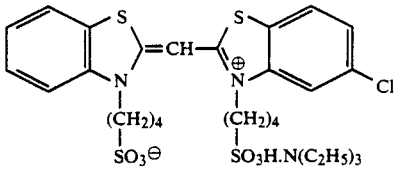
Cpd-1
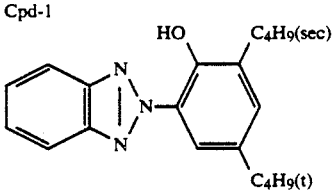
Cpd-2
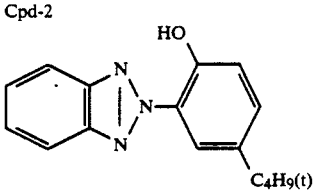
Cpd-3
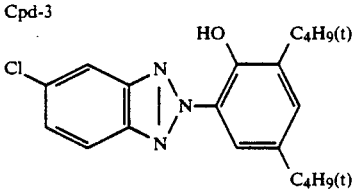
Cpd-4
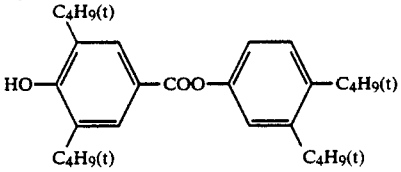
Cdp-5
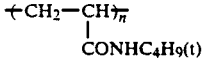
(n = 100 to 1000)
Cpd-6
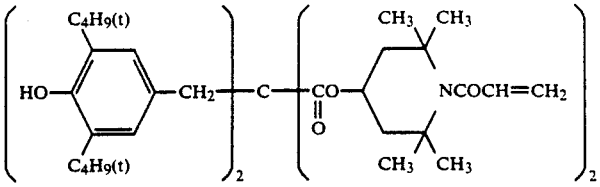

-continued
Cpd-7
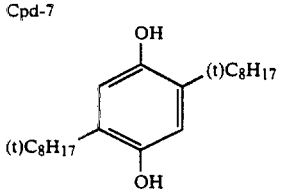
Cpd-8
Polyethylacrylate
Cpd-9
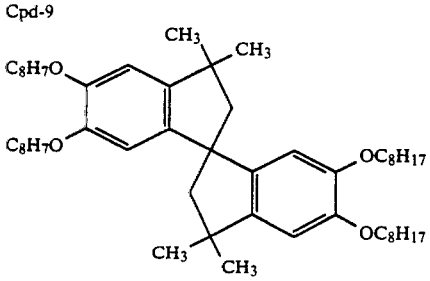
Cpd-10
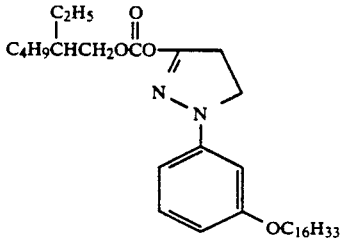
Cpd-11
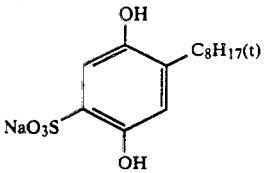
Cpd-12
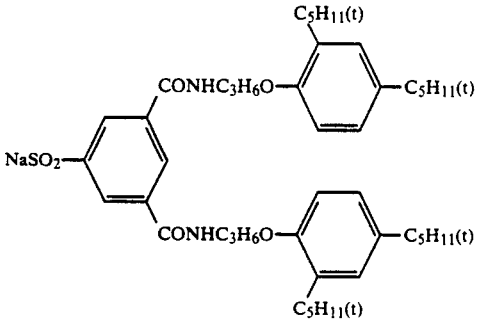
Cpd-13
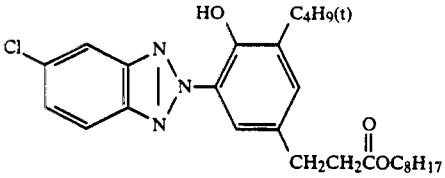
Cpd-14
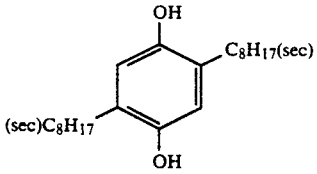
Cpd-15
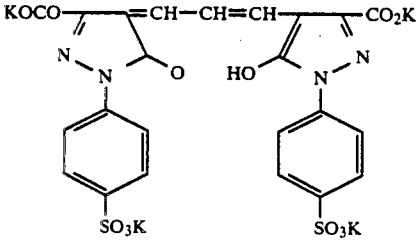
Cpd-16
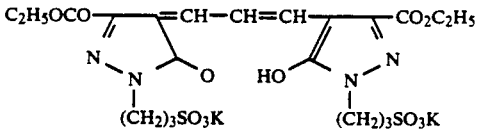
Cdp-17
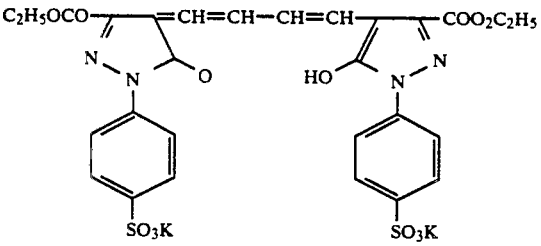
Cpd-18
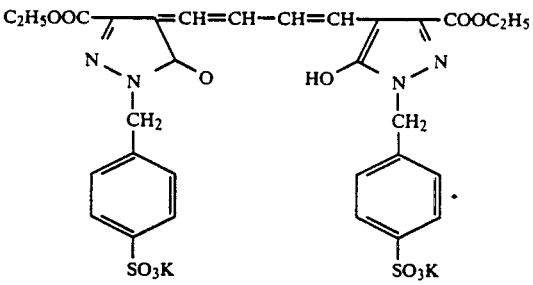
Cpd-19
Cpd-20

-continued
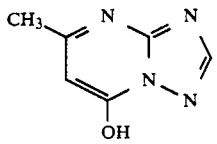
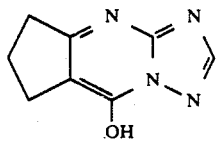
Cpd-21
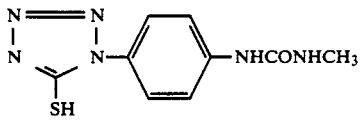
Cpd-22
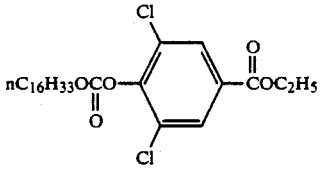
Cpd-23
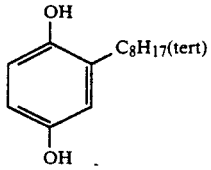
ExC-1
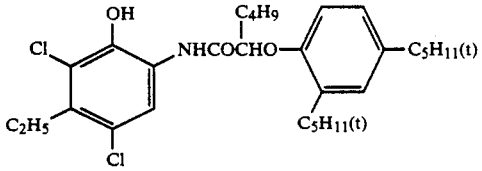
ExC-2
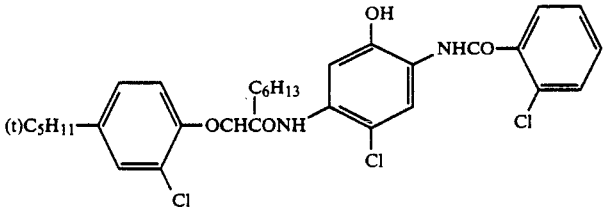
ExC-3
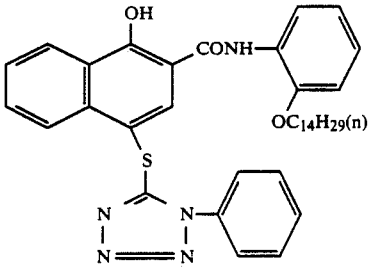
ExM-1
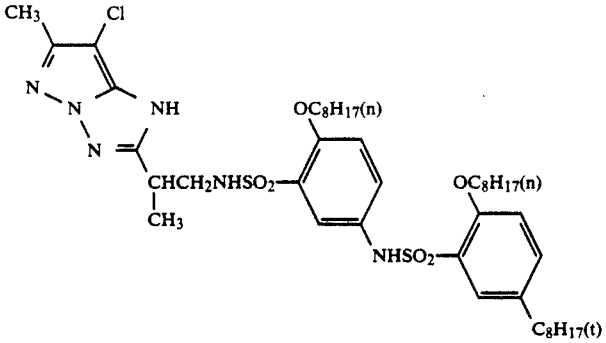
ExM-2
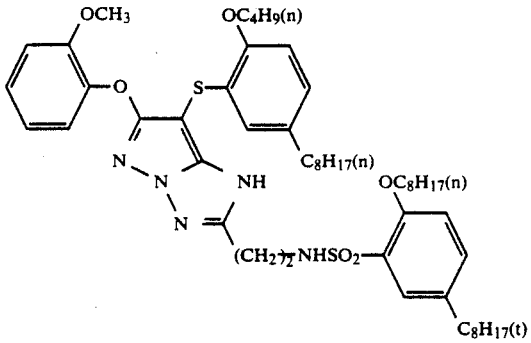
ExM-3

-continued

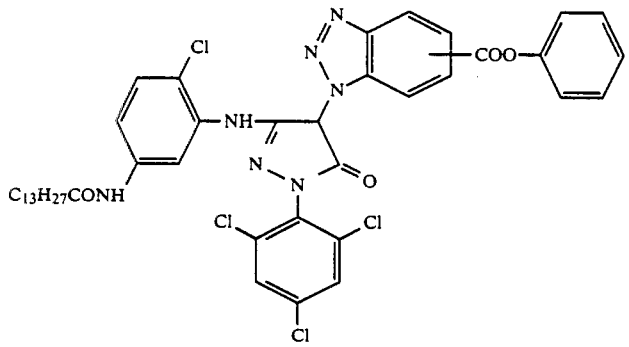

ExD-1

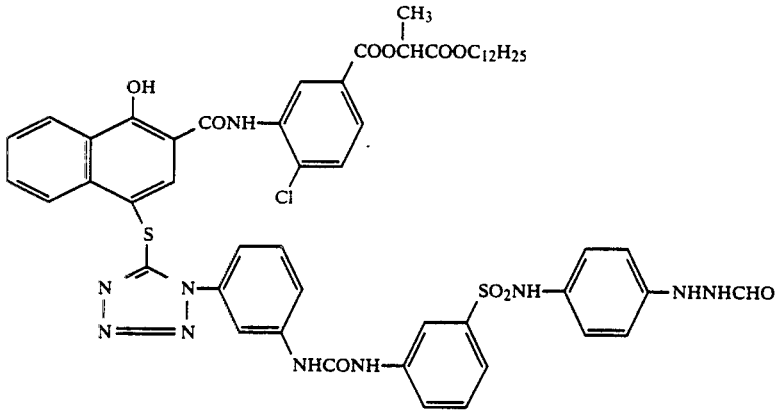

Solv-1
Di(2-ethylhexyl) phthalate

Solv-2
Trinonyl phosphate

Solv-3
Di(3-methylhexyl) phthalate

Solv-4
Tricresyl phosphate

Solv-5
Dibutyl phthalate

Solv-6
Trioctyl phosphate

Solv-7
Di(2-ethylhexyl) sebacate

H-1
1,2-Bis(vinylsulfonylacetamido)ethane

H-2
4,6-Dichloro-2-hydroxy-1,3,5-triazine sodium salt

ExZK-1
7-(3-cyclohexylmethoxythiocarbonylaminobenzamido)-10-propargyl-1,2,3,4-tetrahydroacridiniumtrifluorosulfonate ExY-1

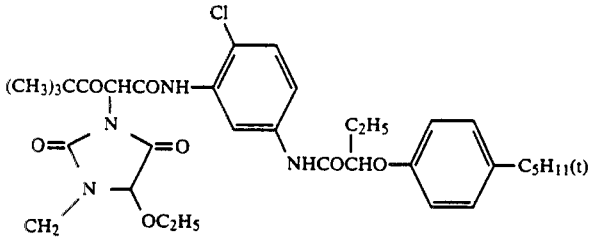

ExY-2

-continued

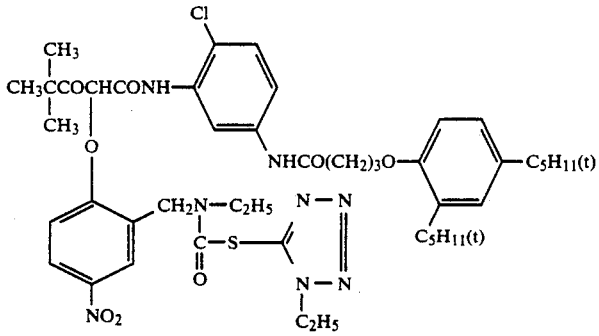

After the imagewise exposure of Sample 201 obtained in the above manner, continuous processing was carried out with the automatic developing machine by the following method until the cumulative replenishment amount of the color developing solution was 3 times the tank capacity (Processing F).

| Processing Stage | Time (sec) | Temperature (°C.) | Mother Liquor Tank Capacity (liter) | Replenishment Amount (ml/m²) |
|---|---|---|---|---|
| Color Development P1 | 135 | 38 | 15 | 300 |
| Bleach-Fixing P2 | 40 | 33 | 3 | 300 |
| Rinsing (1) PS1 | 40 | 33 | 3 | — |
| Rinsing (2) PS2 | 30 | 33 | 3 | 320 |
| Drying | 30 | 80 | | |

The method of replenishment of the rinsing water was a countercurrent replenishment system in which rinsing bath (2) was filled and the overflow from rinsing bath (2) was brought to rinsing bath (1). On this occasion the amount of bleach-fixing solution carried over by the photosensitive material from the bleach-fixing solution to rinsing bath (1) was 35 ml/m², and the ratio of the rinsing water replenishment amount to the amount of bleach-fixing solution carried over was 9.1. The total replenishment amount of bleach-fixing solution (300 ml/m²) was made up of the replenishment amount of bleach-fixing solution replenishment (225 ml/m²) and the replenishment amount of solutions added to the bleach-fixing solution (75 ml/m²).

| | Mother Liquor | Replenisher |
|---|---|---|
| Color Developing Solution: | | |
| D-Sorbitol | 0.15 g | 0.20 g |
| Condensate of Sodium Naphthalenesulfonate/Formaldehyde | 0.15 g | 0.20 g |
| Ethylenediaminetetra-methylene-phosphoric Acid | 1.50 g | 2.00 g |
| Diethylene Glycol | 12.0 ml | 16.0 ml |
| Benzyl Alcohol | 13.5 ml | 18.0 ml |
| Potassium Bromide | 0.70 g | — |
| Benzotriazole | 3.0 mg | 4.0 mg |
| Sodium Sulfite | 2.40 g | 3.20 g |
| Illustrative Compound II-7 | $4.2 \times 10^{-2}$ mol | $3.6 \times 10^{-2}$ mol |
| Illustrative Compound III-1 | $4.2 \times 10^{-2}$ mol | $5.6 \times 10^{-2}$ mol |
| Illustrative Compound V-5 | $1.5 \times 10^{-2}$ mol | $2.0 \times 10^{-2}$ mol |
| N-Ethyl-N-(β-methane-sulfonamidoethyl)-3-methyl-4-aminoaniline Sulfate | 6.50 g | 8.30 g |
| Potassium Carbonate | 30.0 g | 25.0 g |
| Fluorescent Whitener (diaminostilbene based) | 1.0 g | 1.0 g |

-continued

| | | |
|---|---|---|
| Water to make | 1,000 ml | 1,000 ml |
| pH (25° C.) | 10.25 | 10.75 |
| Bleach-Fixing Solution Mother Liquor: | | |
| Disodium Ethylenediaminetetraacetate Dihydrate | | 4.0 g |
| Ferric Ammonium Ethylenediaminetetraacetate Dihydrate | | 108.0 g |
| Ammonium Thiosulfate (700 g/liter) | | 200 ml |
| Sodium p-Toluenesulfinate | | 20.0 g |
| Sodium Bisulfite | | 20.0 g |
| 5-Mercapto-1,3,4-triazole | | 0.5 g |
| Ammonium Nitrate | | 10.0 g |
| Water to make | | 1,000 ml |
| pH (25° C.) | | 6.20 |
| Bleach-Fixing Replenisher (B2): | | |
| Disodium Ethylenediamine-tetraacetate Dihydrate | | 5.33 g |
| Ammonium Thiosulfate (700 g/liter) | | 267.0 ml |
| Sodium p-Toluenesulfinate | | 26.7 ml |
| Sodium Bisulfite | | 26.7 ml |
| 5-Mercapto-1,3,4-triazole | | 0.67 g |
| Water to make | | 1,000 ml |
| pH (25° C.) | | 7.00 |
| Replenisher for Bleach-Fixing Additive Solution (B4): | | |
| Ferric Ammonium Ethylenediaminetetraacetate Dihydrate | | 432.0 g |
| Ammonium Water (27 wt %) | | 66 g |
| Nitric Acid (67 wt %) | | 155 g |
| Water to make | | 1,000 ml |
| pH (25° C.) | | 1.95 |

Rinsing Water

For both the main solution and the replenisher, tap water was passed through a mixed bed column packed with an H-type strongly acidic cation exchange resin ("Amberlite IR-120B" made by Rohm & Haas) and an OH-type anion exchange resin ("Amberlite IR-400" made by Rohm & Haas) and treated to calcium and magnesium concentrations of not more than 3 mg/liter, respectively. This was followed by the addition of 20 mg/liter of sodium dichloroisocyanurate and 1.5 g of sodium sulfate. The pH of this solution ranged from 6.5 to 7.5.

Next, as shown in the Figure, the rinsing water replenisher was run over the entire surface of the conveyor rollers located over the solution surfaces of the various processing baths of color developing solution (bath), bleach-fixing solution (bath) and water rinsing bath (solution) so as to wash them, while in other respects, continuous processing was carried out by the same manner as in Processing F (Processing G). As shown by the Figure, during this operation, the rinsing water was replenished while cleaning the conveyor rollers at the outlet of the final rinsing bath (PS2).

Table 3 shows the results of a comparison of variations in photographic property after continuous processing by Processings F and G. Also, it shows staining and scratching due to processing after cessation for 2 days.

TABLE 3

| No. | Processing | Changes in Photographic Property $\Delta S_{1.0}$ (GL) | Processing Staining | Scratching of Sample Surface | Remarks |
|---|---|---|---|---|---|
| 21 | F | +0.12 | BB | BB | Comparison |
| 22 | G | +0.02 | G | G | Invention |

As shown in Table 3, a preferable result was obtained with the processing method of the present invention, in which the changes in photographic property, staining due to processing and scratching due to processing all were improved.

By means of the present invention a method of processing silver halide color photographic material is obtained in which there is a marked reduction in changes in photographic property even after continuous development processing. Moreover, by this method, the staining and surface scratching of samples due to processing are also markedly reduced, making it most suitable for practical use.

While the invention has been described in detail and with reference to specific embodiments thereof, it will be apparent to one skilled in the art that various changes and modifications can be made therein without departing from the spirit and scope thereof.

What is claimed is:

1. A method for continuously processing imagewise-exposed color coupler-containing silver halide color photographic materials using a roller conveyor type automatic developing apparatus having a roller located over a solution surface of a color developing bath, comprising:

cleaning said roller over the solution surface of a color developing bath using a rinsing water replenisher or a stabilizing replenisher as a substituted for the rinsing water replenisher in an amount of from 0.3 to 0.9 times the amount evaporated from the color developing bath wherein said rinsing water replenisher or said stabilizing replenisher as a substitute for the rinsing water replenisher is then introduced into the color developing bath containing at least one organic preservative selected from the group consisting of compounds represented by formulae (I) and (II):

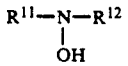

(I)

wherein $R^{11}$ and $R^{12}$ each represents hydrogen atoms, unsubstituted or substituted alkyl groups, unsubstituted or substituted alkenyl groups, unsubstituted or substituted aryl groups or hetero aromatic groups, provided that both $R^{11}$ and $R^{12}$ are not hydrogen atoms together;

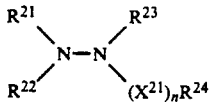

(II)

wherein $R^{21}$, $R^{22}$ and $R^{23}$ each represents independently a hydrogen atom, an alkyl group, an aryl group or a heterocyclic group; $R^{24}$ represents a hydrogen atom, a hydroxyl group, a hydrazino group, an alkyl group, an aryl group, a heterocyclic group, an alkoxy group, an aryloxy group, a carbamoyl group or an amino group; $X^{21}$ represents a divalent group and n represents 0 or 1; with the proviso that when n is $0R^{24}$ represents an alkyl group, an aryl group or a heterocyclic group.

2. The method for processing silver halide color photographic materials as claimed in claim 1, wherein said organic preservative is contained in an amount of 0.005 mol/liter to 0.5 mol/liter per liter of the color developing solution.

3. The method for processing silver halide color photographic materials as claimed in claim 1, wherein said automatic developing apparatus has an open area value of 0.05 $cm^{-1}$ or less.

4. The method for processing silver halide color photographic materials as claimed in claim 1, wherein said roller conveyor type automatic developing apparatus has a roller located over a solution surface of a bath having a bleaching ability and at least one of a rinsing bath and a stabilizing bath, and said roller is cleaned over the solution surface using a rinsing water replenisher or a stabilizing replenisher as a substitute for the rinsing water replenisher, wherein said rinsing water replenisher or a stabilizing replenisher as a substitute for the rinsing water replenisher is then introduced into the bath having a bleaching ability and at least one of the rinsing bath and the stabilizing bath, respectively.

5. The method as claimed in claim 1, wherein said color developing bath further contains at least one organic preservative selected from the group consisting of compounds represented by formulae (III) and (IV):

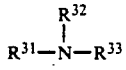

(III)

wherein $R^{31}$, $R^{32}$ and $R^{33}$ each represents hydrogen atoms, alkyl groups, alkenyl groups, aryl groups, aralkyl groups or heterocyclic groups;

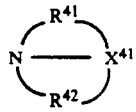

(IV)

wherein $X^{41}$ represents a trivalent atomic group needed to complete a condensed ring and $R^{41}$ and $R^{42}$ each represents alkylene groups, arylene groups, alkenylene groups or aralkylene groups.

6. The method as claimed in claim 1, wherein said color developing bath contains p-phenylenediamine derivatives as color developing agents.

7. The method as claimed in claim 1, wherein said color developing bath contains sulfites in an amount of up to 0.01 mol/l.

8. The method as claimed in claim 1, wherein said color developing bath contains hydroxylamine as a preservative in an amount of up to 0.02 mol/l.

9. The method as claimed in claim 3, wherein said open area value ranges from 0.001 to 0.05 $cm^{-1}$.

10. The method as claimed in claim 4, wherein said bath having a bleaching ability has a pH of 3 to 7.

11. The method as claimed in claim 4, wherein said bath having a bleaching ability has a pH of 5 to 7.

* * * * *